US011702777B1

(12) United States Patent
Head et al.

(10) Patent No.: US 11,702,777 B1
(45) **Date of Patent: *Jul. 18, 2023**

(54) INTERLOCKING BRAIDED STRUCTURES

(71) Applicant: A&P TECHNOLOGY, INC., Cincinnati, OH (US)

(72) Inventors: Andrew Head, Cincinnati, OH (US); Victor M. Ivers, Amelia, OH (US); Alexandra G. Ivers, Amelia, OH (US)

(73) Assignee: A&P TECHNOLOGY, INC., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/001,468

(22) Filed: Aug. 24, 2020

Related U.S. Application Data

(63) Continuation of application No. 16/113,799, filed on Aug. 27, 2018, now abandoned, which is a continuation of application No. 15/146,852, filed on May 4, 2016, now Pat. No. 10,060,056.

(60) Provisional application No. 62/156,366, filed on May 4, 2015.

(51) Int. Cl.

| | |
|---|---|
| ***D04C 3/08*** | (2006.01) |
| ***D04C 1/06*** | (2006.01) |
| ***D04C 3/48*** | (2006.01) |
| ***D04C 1/00*** | (2006.01) |

(52) U.S. Cl.
CPC ..... *D04C 3/08* (2013.01); *D04C 1/00* (2013.01); *D04C 1/06* (2013.01); *D04C 3/48* (2013.01); *D10B 2505/02* (2013.01)

(58) Field of Classification Search
CPC ... D04C 3/00; D04C 3/02; D04C 3/08; D04C 3/48; D04C 1/00; D04C 1/06; D10B 2505/02
See application file for complete search history.

(56) References Cited

U.S. PATENT DOCUMENTS

| | | | | | |
|---|---|---|---|---|---|
| 552,994 | A | * | 1/1896 | Fisher | D04C 3/00 87/50 |
| 896,320 | A | * | 8/1908 | Rahm | D07B 1/18 87/8 |
| 936,356 | A | * | 10/1909 | Rahm | D04C 3/00 87/37 |
| 949,245 | A | * | 2/1910 | Orthmann | D04C 3/00 87/37 |
| 1,106,658 | A | * | 8/1914 | Luckwell | D07B 1/18 87/8 |
| 1,849,627 | A | * | 3/1932 | Krissiep | D04C 3/20 87/30 |

(Continued)

*Primary Examiner* — Bao-Thieu L Nguyen
(74) *Attorney, Agent, or Firm* — FisherBroyles, LLP; Jeremy P. Sanders

(57) ABSTRACT

A composite structural component including a braided material embedded in a resin matrix, the braided material with multiple braided components formed of continuous tows and connected by one or more intersections are described. Each of the multiple braided components is formed by sets of tows. Each set of tows includes a respective plurality of tows, which are substantially adjacent and parallel to each other at an angle relative to the longitudinal axis of the braided material. Each set of tows is further composed of multiple subsets of tows. The subsets of tows separate at the intersections and combine with different subsets of tows in adjacent components of the multiple braided components.

9 Claims, 29 Drawing Sheets

(56) References Cited

U.S. PATENT DOCUMENTS 1,891,211 A * 12/1932 Blaisdell ..... D04C 3/20 87/6
1,990,880 A * 2/1935 Reuter ..... F16D 69/022 87/8
2,018,596 A * 10/1935 Blaisdell ..... D04C 3/16 87/23
2,949,807 A * 8/1960 Herzog ..... A01K 75/00 87/8
4,719,837 A * 1/1988 McConnell ..... D04C 3/48 87/8
5,067,525 A * 11/1991 Tsuzuki ..... D04C 3/18 139/11
5,108,810 A * 4/1992 Williams ..... B29C 70/222 428/36.1
5,287,790 A * 2/1994 Akiyama ..... D04C 3/48 87/9
5,348,056 A * 9/1994 Tsuzuki ..... D04C 1/06 139/384 R
5,385,077 A * 1/1995 Akiyama ..... B29C 70/24 87/8
5,388,498 A * 2/1995 Dent ..... D04C 3/08 87/50
5,396,829 A * 3/1995 Akiyama ..... B29C 70/16 87/29
5,438,904 A * 8/1995 Uozumi ..... D04C 3/12 87/6
5,934,168 A * 8/1999 Feichtinger ..... D07B 5/005 87/8
6,121,547 A * 9/2000 Harada ..... H01B 5/12 174/109
6,128,998 A * 10/2000 Freitas ..... D04C 3/00 87/8
6,250,193 B1 * 6/2001 Head ..... D04C 3/48 87/8
6,598,510 B1 * 7/2003 Kim ..... D04C 1/12 87/8
6,647,852 B1 * 11/2003 Freitas ..... B29C 70/222 87/8
6,907,810 B2 * 6/2005 Kim ..... D04C 3/06 87/16
8,440,276 B2 * 5/2013 Rose ..... B32B 3/28 428/36.1
8,541,090 B2 * 9/2013 Nagelsmit ..... B29C 70/202 428/36.1
9,388,903 B2 * 7/2016 Starbile ..... F16J 15/22
10,060,056 B1 * 8/2018 Head ..... D04C 3/08
2013/0216770 A1 * 8/2013 Gilbertson ..... D03D 1/00 139/408
2014/0230634 A1 * 8/2014 Nakai ..... C08J 5/24 87/8
2015/0045831 A1 * 2/2015 Allen ..... A61F 2/0811 87/8
2015/0059563 A1 * 3/2015 Kirth ..... D04C 3/48 87/6
2016/0010248 A1 * 1/2016 Lariviere ..... D04C 1/06 87/8

* cited by examiner

INTERLOCKING BRAIDED STRUCTURES

CROSS-REFERENCE TO RELATED APPLICATIONS

This patent application is a continuation of U.S. patent application Ser. No. 16/113,799, filed Aug. 27, 2018, which is a continuation of U.S. patent application Ser. No. 15/146,852, filed May 4, 2016, now U.S. Pat. No. 10,006,056, which claims priority to U.S. Provisional Application No. 62/156,366 filed May 4, 2015, each of which are incorporated by reference herein in their entirety.

TECHNICAL FIELD

The present subject matter relates to a method for the formation of interlocking braided structures.

BACKGROUND

Conventional maypole braiding machines generally include, in one example, a single braiding ring on which tow carrier devices can move to produce a tubular braided structure. In some cases, the completed individual tubular braided structure is then attached to one or more separately produced individual tubular braided structure(s) by various approaches, including stitching, etc. There is a need to produce an interlocking structure including two or more independent tubular braided structures with tows connecting the independent tubular braided structures.

BRIEF DESCRIPTION OF DRAWINGS

The detailed description is described with reference to the accompanying figures. The use of the same reference numbers in different figures indicates similar or identical components or features.

DETAILED DESCRIPTION

Figure 1B:
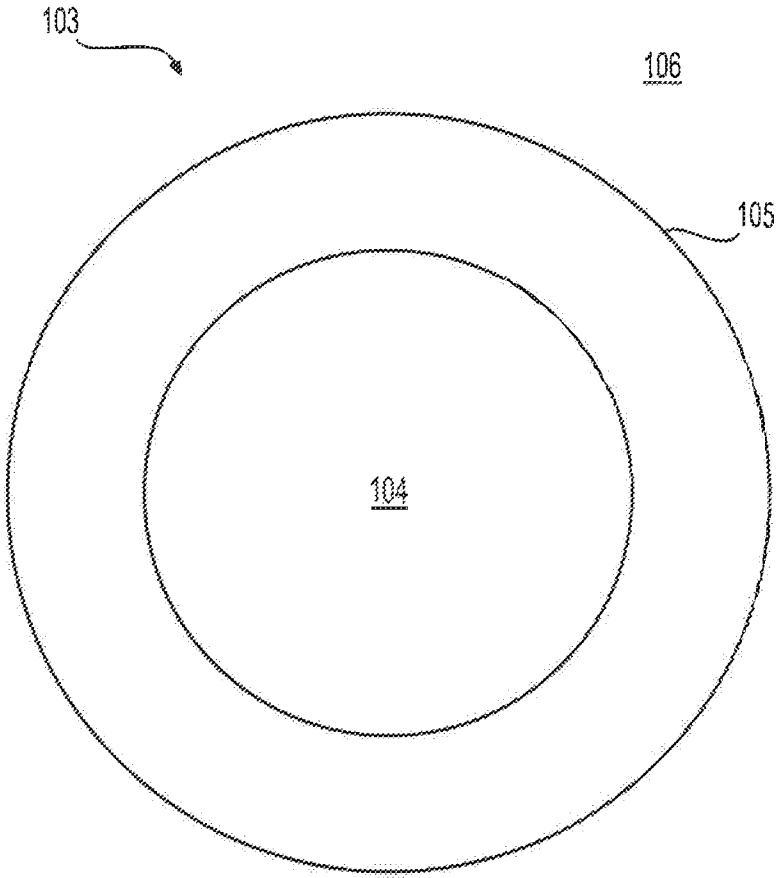
FIG. 1B is illustrative of a conventional maypole style braiding machine simplified as a ring.

The present subject matter relates to a method for the creation of interlocking braided structures for the manufacture of three-dimensional braided structures and composite assemblies.

Braided structures are used extensively in the manufacture of composite parts as reinforcements materials embedded in a resin matrix. It is also known to use braided structures as distinct components within an assembly of parts, for instance, as a blade-out containment component in a jet engine component. Braided structures are often preferred over other types of structures, such as woven structures, because tows of material within the structure may be oriented along non-perpendicular directions and the structures may either conform to a surface upon application or be manufactured in to conform to a specific surface.

As used herein, a "braided structure" is a product comprised of three or more strands of material (tows) such that each tow is joined with other tows in a repeating intertwined pattern. Two-dimensional braided materials are those wherein the repeating pattern is largely characterized by two or more principal directions in a plane, typically the longitudinal direction of the braided structure, commonly called the longitudinal axis, or the axial direction, and one or more oblique directions, commonly called bias directions, each at a predetermined angle to the longitudinal axis or direction. The term longitudinal axis as used in the specification herein refers to an axis generally perpendicular to the braiding machine track along which a braided structure is formed. This longitudinal axis is additionally described in reference to braided structures in which bias tow materials are oriented in angular positions in reference to the longitudinal axis of the braided structure, or along the axis in which the braided structure was formed. Examples of bias directions for various braiding architectures with respect to the longitudinal axis include 45° and 60° angular positions. Three-dimensional braided structures are those wherein additional principal directions, generally mutually perpendicular to the longitudinal and oblique directions, are required to completely define the structure and the patterns thereof. For simplicity of description, these additional directions are genetically referred to as radial directions, whether the structure is generally tubular in form, laid out as a flattened tubular form or in a fabric, or generally planar form.

Two-dimensional braided structures may be manufactured as generally cylindrical materials, commonly called sleeves, with the axial direction corresponding to the longitudinal axis of the cylinder and the bias directions oblique to the longitudinal axis. Braided structures manufactured in cylindrical form may then be laid-flat to form a two-dimensional fabric comprised of two layers joined along the longitudinal edges. The edges may be removed to form two separate and distinct layers. One edge may be removed and the cylindrical structure laid-flat to form a slit single layer structure. Two edges may be removed to form a double-slit two-layer structure. Two-dimensional braided structures may further be manufactured in a single layer flat form, commonly called a tape.

In this disclosure reference to braided structure generally implies two-dimensional forms but does not exclude three-dimensional forms.

In this disclosure reference to braided fabric is generally directed to two-dimensional fabric forms but one skilled in the art recognizes that three-dimensional braided materials may be used in particular embodiments of the present invention as desired to satisfy requirements of particular applications.

Common terms used to describe braided structures are based on a Cartesian system of directions and rotations as applied to a plane surface considered to be formed from cylindrical surface after it is slit in the direction of the longitudinal axis and the cylindrical surface rolled out into a plane.

The longitudinal axis of braided structures is often used as a reference direction when describing the orientations of sets of tows in the braided structure. Directions oblique to the longitudinal axis are often referred to as bias directions. Oblique directions oriented at angles clockwise to the longitudinal axis are generally referred to as positive bias directions and those oriented at angles counterclockwise to the longitudinal axis are generally referred to as negative bias directions.

Biaxial braided structures may comprise two sets of tows, one set oriented along a positive bias direction and the other set along a negative bias direction. A typical shorthand description of the orientations of the two sets of tows within a biaxial braided structure is that a first set of tows may be comprised of a positive number and the second set may be comprised of a negative number each numerating the bias angle for a set of tows. For example, a biaxial braided structure called Bimax, manufactured by A&P Technology, Inc., is designated as a +45°/−45° braid.

A set of tows as described herein may be defined such that a set of tows may include a plurality of tows oriented to be substantially adjacent and parallel to each other at an angle relative to the longitudinal axis of the braided structure wherein each set of tows may include a plurality of subsets of tows. The plurality of sets of tows may be oriented such that at least one set of tows may be at a substantially different angle with respect to the longitudinal axis to at least a second set of tows. Additionally, the sets of tows may intertwine to form a complete unit cell within a braided structure.

A unit cell may be defined in the specification herein as the minimum pattern of intertwining tows, which may be required to uniquely characterize a braided structure. Further, a unit cell may also be defined as the smallest repeating unit, or structure, of a braided structure. In an example of a diamond braid structure which may be comprised of a repeating pattern of one clockwise traveling tow passing over one counterclockwise traveling tow and passing under one counterclockwise traveling tow, while one counterclockwise tow may pass under one clockwise traveling tow and over one clockwise traveling tow, a minimum of three tows are required to uniquely characterize the braided structure to achieve the repeating pattern, as well as to create the smallest repeating structure that comprises the braided structure. In the case of a diamond braid structure three tows are necessary to characterize the one over and one under pattern of the braided structure such that the one over one under pattern is characterized in the unit cell of the braided structure.

Additionally, to uniquely characterize a regular braid comprised of a repeating pattern of two clockwise traveling tows passing over two counterclockwise traveling tows and passing under two counterclockwise traveling tows, while two counterclockwise traveling tows may pass under two clockwise traveling tows and over two clockwise traveling tows, five tows are required to uniquely characterize the braided structure to achieve a repeating pattern. In the case of a regular braid structure five tows are necessary to characterize, or capture, the two over two under pattern of the braided structure such that the two over, two under pattern is characterized in the unit cell of the braided structure.

Therefore, for any braided structure comprised of a repeating pattern of N tows, such that N is an integer greater than one, passing over and under each other in a repeating pattern, a total of 2N+1 tows are required to uniquely characterize the braided structure and to create the smallest repeating unit of the braided structure.

An inherent feature of biaxial braided structures is that the tows comprising the braided structure may move relative to one another and allow the braided structure to conform to a range of surfaces without compromising the braided structure or the tows. After conformation to a specific surface the general relative orientation of tows within subsets of a set and subset to subset is maintained and may be best understood by considering the Cartesian system to have been mapped onto the surface.

Triaxial braided structures may be manufactured to conform to a specific surface at the time of manufacture by overbraiding onto a specific surface so that the locking action of the axial tows occurs as the braided structure is laid on the surface and the geometry of the braided structure assumes and retains its as-manufactured configuration.

The addition of axial tows restricts relative motion of tows thereby generally locking the structure in the as-manufactured geometry. Triaxial braided structures are generally used in sheet or tubular form or are manufactured to conform to a specific surface at the time of manufacture.

Triaxial braided structures have three sets of tows. Two sets are oriented as described for biaxial structures. The third set of tows is oriented along the longitudinal axis and intertwined with the first and second set of tows. A typical shorthand description for a triaxial braid structure includes the angular orientation of each tow set relative to the longitudinal axis and the longitudinal axis itself to better convey that the braided structure is triaxial. For example, a triaxial braided structure marketed as Qiso, manufactured by A&P Technology, is designated as a +60°/0°/−60° braid structure.

The terms "strand", "tow", "yarn", "yarn bundle", "fiber" and "fiber bundle" are generally meant to describe a primary intertwined component of the braided structure, laid in each of the principal directions. The tow itself may be comprised of multiple components (e.g., individual filaments) that run together in a principal direction. A tow may comprise monofilament arrangements, multiple filament arrangements or be comprised of staple or spun material. Tow material may have a variety of cross-sectional shapes, including but not limited to, circular, ellipsoidal, triangular and flat tape shapes, as well as other variants thereof. Tow material may be subject to intermediate or pre-processing prior to braiding operations. Examples of intermediate or pre-processing may include, but are not limited to, twisting, braiding small numbers of filaments into braided tow materials, pre-impregnation with resins and specialty coating to facilitate braiding and/or subsequent processing. A tow may comprise any combination of these materials and material forms. Any one tow may comprise one or more filament or staple materials. As examples, a tow may be comprised of carbon materials, basalt, glass materials, thermoplastic polymeric materials, thermoset polymeric materials, a combination of carbon and polymeric materials or a combination of polymeric and glass materials, or some combination thereof. Tows that lay in one of the bias directions of the fabric are commonly called bias tows. Tows that lay along the longitudinal axis of the fabric are commonly called axial tows.

As used herein, the term braid architecture may be defined as the pattern in which tow materials oriented in bias directions may be intertwined to form a braided structure in Which an integer. N, of clockwise oriented tows may pass over and under N counterclockwise oriented tows and in which an integer, N, of counterclockwise oriented tows may pass under and over N clockwise traveling tows. The term braid architecture may also describe, in additional manners, the types of tow materials which comprise a braided structure including in an example braided structures comprised of axial and bias tows for the formation of a triaxial braided structure, or braided products comprised only of bias tows for the formation of a biaxial braided structure, or braided structures comprised of sections of biaxial and triaxial sections, or hybrid braided structures. As used herein, biaxial braid describes braided structures comprised of bias tows. Triaxial braid is comprised of bias and axial tows. Hybrid braided structure are comprised of continuous tow materials comprising adjacent regions of biaxial and triaxial braided structures.

The term continuous as described herein refers to unbroken lengths of a tow material within a braided structure. Disruption in the length of a tow may be described as the presence of splices, stitching, tying or other methods of cutting and reaffixing portions of tow material to one another.

In the art several terms in common use describe the most common braid architectures. For example, in regular or plain braid architecture each bias tow is intertwined into the structure such that it passes over two bias tows in a substantially opposing bias direction and under two bias tows in a substantially opposing bias direction in a repeated pattern. The numerical designation 2×2, typically read as "two-over, two-under", may be used to define this pattern. Similarly, Hercules braid architecture is a 3×3 architecture wherein each bias tow passes over three bias tows in a substantially opposing bias direction then under three bias tows in a substantially opposing bias direction in a repeated pattern. Further, diamond braid architecture is 1×1 architecture.

As used herein, a braiding machine is an apparatus for manufacture of braided structures. Said machine may be specific to particular braid architecture or family of related braid architectures or general in that it may produce multiple braid architectures. Examples of braiding machines include maypole braiding machines or 3D braiding machines.

Biaxial and triaxial two-dimensional braids are commonly made on maypole braiding machines. A maypole braiding machine is generally comprised of a flat ring assembly on which tow carrier devices are deployed. The tow carrier devices are transported along the circumferential direction of the flat ring and caused to move in and out along the radial direction. One group of tow carrier devices, generally half the number of total tow carriers deployed in the machine, moves in the counterclockwise, or S, circumferential direction and another group of tow carrier devices moves in the clockwise, or Z, circumferential direction. For description purposes, the tow carrier devices moving in the S circumferential direction are called the S carriers and those moving in the Z circumferential direction are called the Z carriers. The combination of circumferential and inner and outer radial motion affects intertwining of the S and Z carriers. For a regular or plain 2×2 braid, the S and Z carriers move in the circumferential and radial directions so that the tow paid out by each S carrier passes over two Z carrier tows and under two Z carrier tows in a repeated pattern and vice versa for Z and S carriers.

Conventional braiding machines may be comprised of a plurality of tow carrier devices dispersed around a braiding machine track. Braided products formed by conventional braiding machines may be comprised of a two over, two under (2×2) braid architecture in which two clockwise traveling tow carrier devices may pass over two counterclockwise traveling tow carrier devices and under two counterclockwise traveling tow carrier devices, while two counterclockwise traveling tow carrier devices may pass under two clockwise traveling tow carrier devices and over two clockwise traveling tow carrier devices in a repeating pattern. Tow carrier devices may travel circumferentially as well as radially inwards and outwards around the braiding machine track to promote the intertwining of tows to form the braided structure.

Braided structures created using conventional braiding machines may comprise biaxial or triaxial tubular structures which may be overbraided onto a variety of preforms or core materials to form a composite part. As a result of overbraiding, the shape of generally tubular conventional braided structures may be altered to conform to the surface of the preform or core material. Further, a lasting structural shape may be induced during the braiding process through changes in the length of axial tows due to differences in the rate in which axial tows may be drawn into the braided structure as a result of the geometry of the preform.

While composite parts created using conventional braided structures may have particular utility in a variety of applications, the creation of assemblies of composite parts may require secondary production processes including, but not limited to, gluing, stitching, bolting, or otherwise affixing two or more composite parts to one another. Additionally, the creation of three dimensional composite structural members, which may have particular utility in aerospace applications, may further require secondary production processes to create pi, I or T shaped braided structures. Tubular sleeve products may be molded, shaped, stitched, glued or stapled to maintain the tubular sleeve product in a three dimensional form.

Described herein is an interlocking braided structure comprised of two or more interlocked braided structures, including sleeves or tape braid structures, which may have particular utility for the creation of composite assemblies and three dimensional braided structures. The braiding machine for the creation of interlocking braided structures of embodiments herein may be comprised of a flat ring assembly comprising two or more braiding machine tracks which may be interlocked through a portion of shared track, or a portion of braiding machine track common to two or more braiding machine tracks. In embodiments of the present subject matter, the portion of shared track may comprise several horn gears, to be discussed in the specification herein, while in others, the portion of shared track may comprise a single horn gear. Further, the braiding machine of embodiments of the present subject matter may comprise a plurality of sets of tow carrier devices, comprising spools of tow materials, for the creation of the interlocking braided structures of embodiments herein.

Conventional maypole style braiding machines may be comprised of a singular tow carrier track, as described herein, and may generally be comprised of two sets of tow carrier devices. The first set of tow carrier devices may travel in the clockwise direction, and the second set may travel in the counterclockwise direction around the braiding machine track. Clockwise traveling tow carrier devices, comprising the first set of tow carrier devices may be referred to as Z tow carrier devices while counterclockwise traveling tow carrier devices comprising the second set may be referred to as S tow carrier devices. A braided structure may be formed through the intertwining of tow materials affixed to S and Z tow carrier devices, comprising the two sets, as a result of the radial and circumferential movement of tow carrier devices around the braiding machine track. Further, S and Z tow carrier devices comprising each set may travel only in the S and Z directions, or counterclockwise and clockwise directions respectfully, and generally may not change direction. In an example, an S tow carrier device may never switch directions, from the counterclockwise direction to the clockwise direction, and become part of the first set comprising Z tow carrier devices. Therefore conventional maypole style braiding machines may comprise two sets of tow carrier devices traveling in different directions for the creation of a complete unit cell and the formation of a braided structure.

The braiding machine of an embodiment of the interlocking braided structure herein may be comprised of a plurality of sets of tow carrier devices affixed with spools of tow material, each comprising a plurality of subsets of tow carrier devices, or tows. The tow carrier devices comprising each subset may be determined by two factors; time, defined by the longitudinal length of the braided structure at a specific interval during the braiding process, and the position of the tow carrier within the braiding machine track comprising the braiding machine.

In embodiments of the braiding machine herein, a set of tow carrier devices may change directions such that the set of tows originally traveling in a clockwise direction may travel in the counterclockwise direction. Additionally, tow carrier devices in the second set of tows traveling in a counterclockwise direction may change directions such that the tow carrier devices begin to travel in the clockwise direction.

Within conventional braiding machines, S tow carrier devices comprising a second set may only travel around the braiding machine track on S edges of the braiding machine track while Z tow carrier devices, comprising a first set of tows, may only travel on Z edges of the braiding machine track.

Within the braiding machine of embodiments of the present subject matter, a single tow carrier device comprising any subset may travel along all S and Z edges which comprise the braiding machine track. Therefore, any tow carrier device may occupy any point on the braiding machine track at different points in time, defined by the longitudinal length of the braided structure.

In additional embodiments of the braiding machine of the present subject matter, a single tow carrier device comprising part of a set may only travel on S or Z edges of the braiding machine track like that for a conventional 2×2 braiding machine.

The positions and edges of a braiding machine track on which a single tow carrier device may travel may be determined by the configuration of interlocking braiding machine paths for the formation of the interlocking braided structure.

Figure 1A:
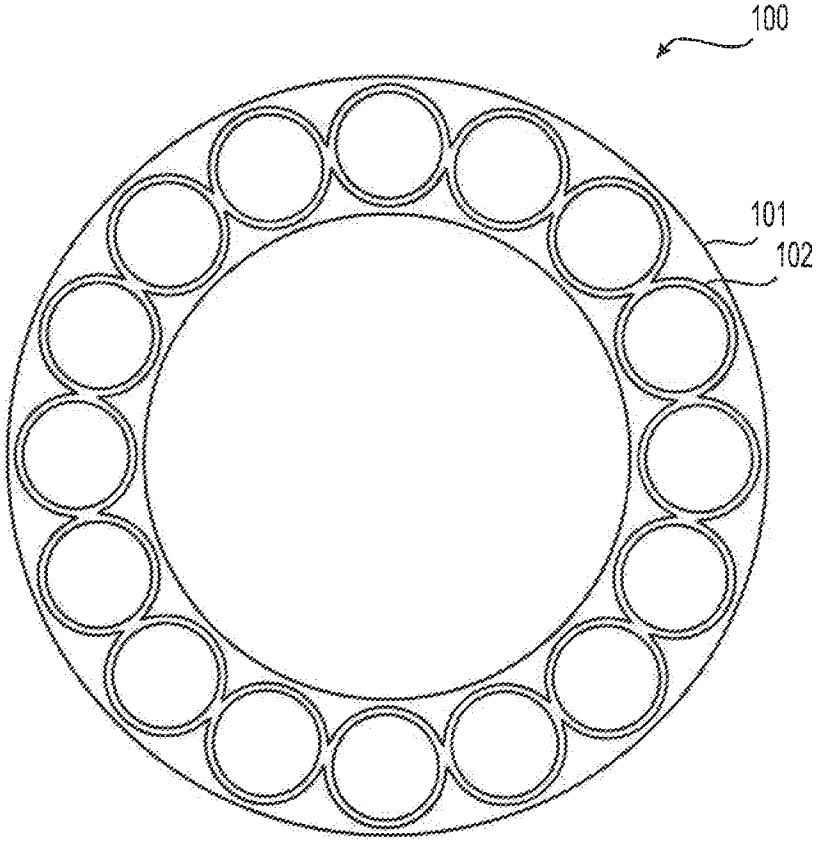
FIG. 1A is illustrative of simplification of a conventional maypole style braiding machine.

As illustrated in FIGS. 1A-1B, a flat ring assembly 101 comprising a braiding machine track 102 of a conventional braiding machine 100 may be simplified for discussion purposes as a ring 103. Additionally, each ring 103 may be illustrative of the cross section of a braided structure produced on the braiding machine. In an example of a. FIGS. 1A-1B, the flat ring assembly 101 comprising the braiding machine track 102 of the conventional braiding machine 100 may be simplified as a "doughnut" shaped ring 103 which may also be representative of a cross section of a tubular braided structure.

Each ring 103, illustrative of a simplification of a braiding machine 100, may be comprised of three distinct sections, a peripheral 106, a core 104 and a path 105. The path 105 of the ring 103 may be illustrative of the flat ring assembly 101 comprising the braiding machine track 102 of the braiding machine 100, the core 104 may be illustrative of the center of the braiding machine 100, or the area inside the path 105 through which preforms may be inserted while the peripheral 106 of a ring 103 may be described as the area outside the path 105.

Figure 2:
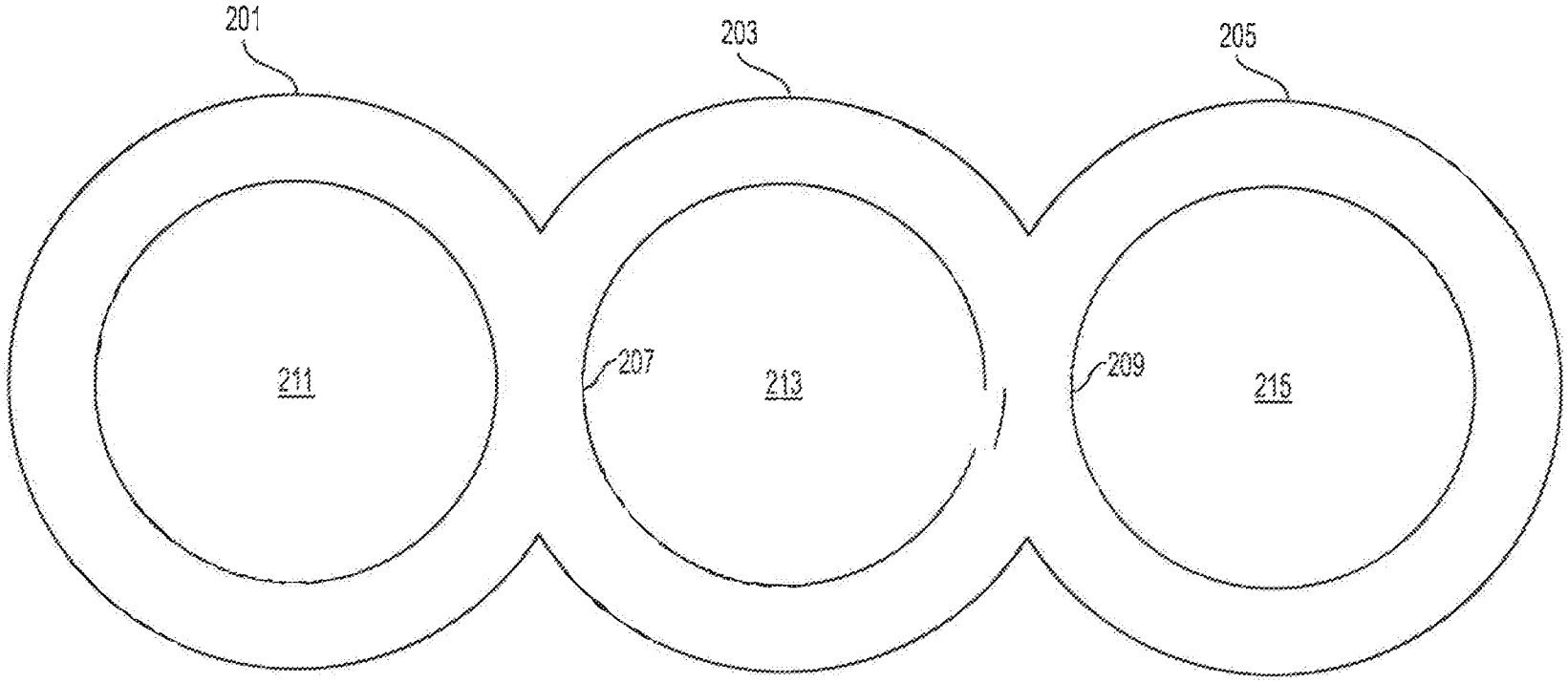
FIG. 2 illustrates a simple configuration of interlocking braiding machine paths.

In an example of three interlocked braiding machine paths, 201, 203 and 205, illustrated in FIG. 2, aligned horizontally with one another the paths, 201, 203 and 205, of each of the rings may intersect forming portions of shared path, 207 and 209, and therefore portions of shared, or common braiding machine track.

In embodiments of the interlocking braiding machine and interlocking braided structure of the present subject matter illustrated in an example in FIG. 2, different preforms or core materials may be inserted into each core, 211, 213 and 215 during the braiding process for the creation of a composite structure or assembly. In an example, core 211 may be inserted with Kevlar fibers, core 213 may be inserted with carbon fibers and core 215 may be inserted with fiberglass fibers.

In additional embodiments of the present subject matter, the braid architecture between interlocking braiding machine paths may vary such that path 201 may comprise a 1×1 braid architecture, path 203 may comprise a 2×2 braid architecture and path 205 may comprise a 3×3 braid architecture.

Further, in additional embodiments of the braiding machine and interlocking braided structure described herein the tow materials comprising the interlocking braided structures may vary such that tow materials may be blended together in such a way to create material gradients within the interlocking braided structure.

In subsequent embodiments of the interlocking braided structure of the present subject matter, the blending of tow materials within the braided structure may result in decreased stress concentration between different materials and may result in the formation of varying sections of flexibility within the braided structure. An additional stiffness gradient may be induced in an interlocking braided structure through the incorporation of axial tows within the braided structure. Different paths comprising the interlocking braiding machine of embodiments herein may comprise varying pluralities of axial tow fibers to stiffen specific sections of the interlocking braided structure.

Figure 3B:
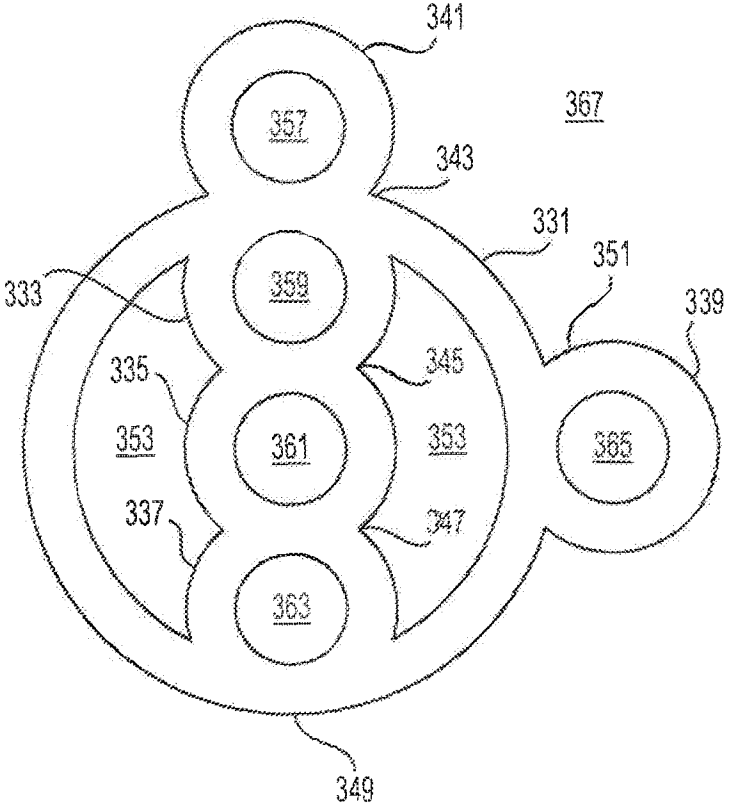
FIG. 3B is illustrative of a complex configuration of interlocking braiding machine paths in which a plurality of interlocking braiding machine paths are comprised in the peripheral of a plurality of other paths.
Figure 3A:
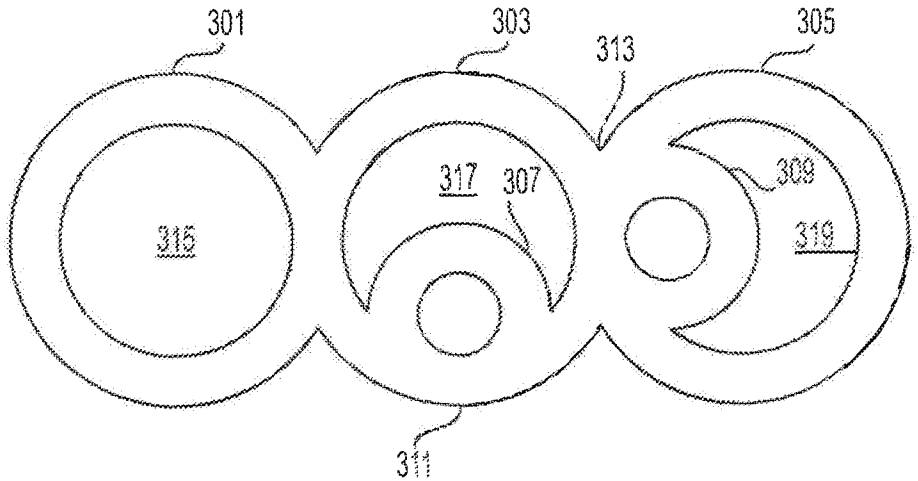
FIG. 3A illustrates a complex configuration of interlocking braiding machine paths in which a plurality of paths are comprised within cores of other paths.

Paths may be interlocked with one another in a plurality of different locations. In an example illustrated in FIG. 3A, three horizontally aligned interlocking paths, 301, 303 and 305, may be interlocked with two additional paths, 307 and 309. The first of these additional paths 307 may be interlocked with the central interlocking path 303 such that the first path 307 is located within the core 317 of the central path 303 and such that it shares a portion 311 of only the central path 303. The second of these paths 309 may be interlocked with both the central path 303 and the rightmost path 305 such that the second path 309 is located in the core 319 of the rightmost path 305 and such that it shares a portion 313 of common path between the central path 303 and the rightmost path 305. Path 301, comprising core 315 may additionally only be interlocked with path 303.

Further, as illustrated in FIG. 313, interlocking paths may be interlocked on the peripheral of interlocking braiding machine paths as well as within the cores of interlocking braiding machine paths. Within FIG. 313 three interlocking braiding machine paths 333, 335 and 337, comprising cores 359, 361 and 363, may be comprised within the core 353 of path 331. Within the core 353 of path 331 paths 333 and 335 share a portion of common path 345 while paths 335 and 337 share a portion of common path 347. Further, paths 333 and 331 share a portion of common path 343, while paths 337 and 331 share a portion of common path 349. Additionally, path 341, comprising core 357, located in the peripheral 367 of path 331 may be interlocked with paths 331 and 333 such that a portion of common path 343 is formed between all three paths. Subsequently, path 339, comprising core 365, may be interlocked with path 331 such that the two paths share a portion of common path 351.

Figure 4:
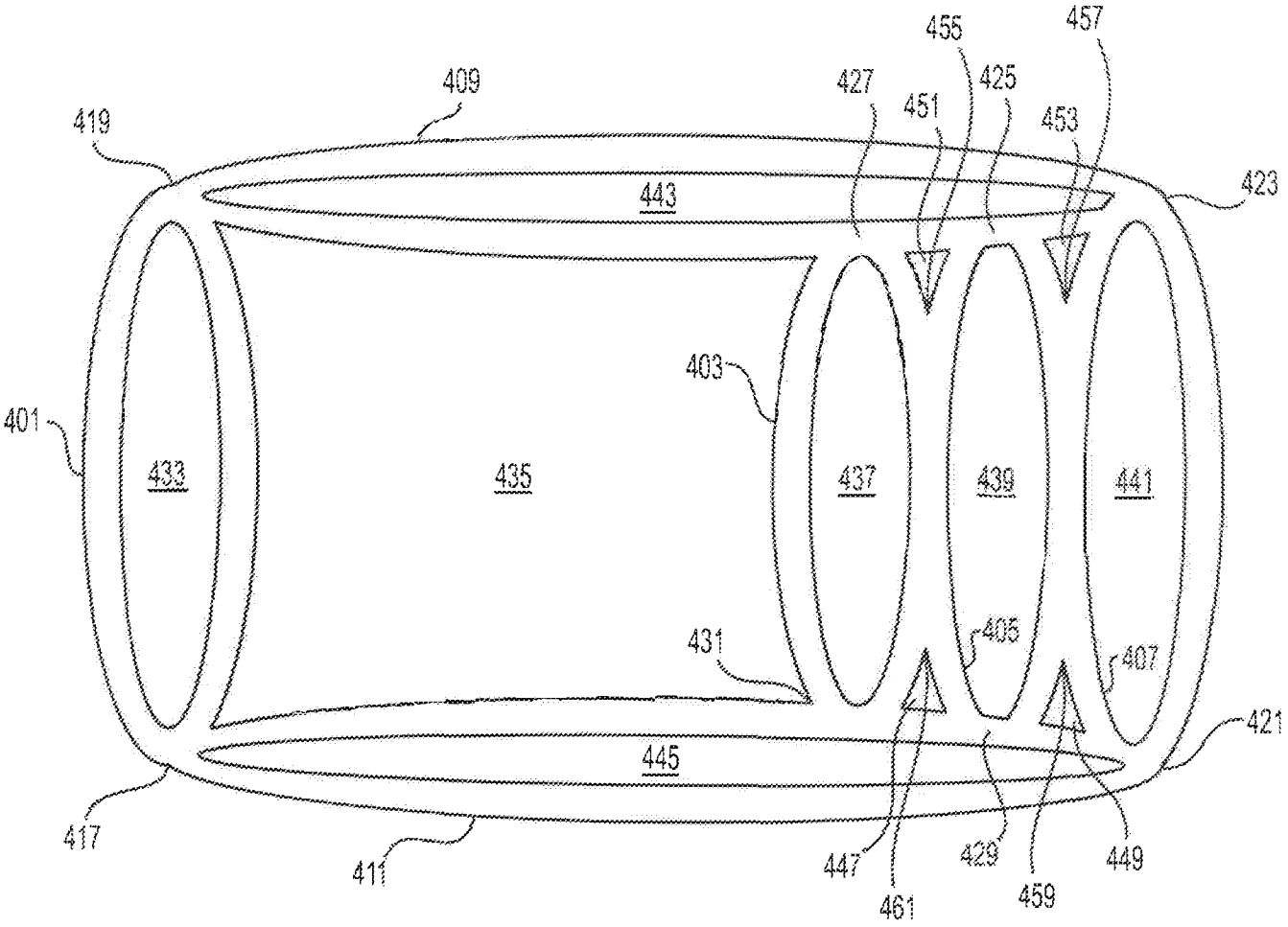
FIG. 4 is illustrative of a complex configuration of interlocking braiding machine paths which may be used for the formation of a composite assembly.

An additional embodiment of a plurality of interlocking braiding machine paths is illustrated in FIG. 4. The interlocking braiding machine of FIG. 4 may be employed for the creation of a complex composite assembly in which a variety of different preforms may be inserted into the cores of the primary and secondary paths to create a composite assembly which may require little to no secondary production techniques. Additionally, the interlocking braided structure produced by the interlocking braiding machine illustrated in FIG. 4 may have a cross section generally similar to that of the interlocking braiding machine paths depicted.

The interlocking of braiding machine paths may result in the formation of secondary paths in addition to primary interlocking paths. A primary interlocking path may be defined as a circular or elliptical path of a braiding machine while a secondary path may be defined as a path formed as a result of the interlocking of two or more primary paths.

The interlocking braiding machine of FIG. 4 may be comprised of six primary braiding machine paths, 401, 403, 405, 407, 409 and 411, and each of these paths may comprise a core, 433, 437, 439, 441, 443 and 445. Further, the interlocking braiding machine of FIG. 4 may comprise at least six secondary interlocking braiding machine paths. One such secondary path comprising the interlocking braiding machine of FIG. 4 may be comprised of the innermost portions of paths 401, 409, 403 and 411 such that a secondary path comprising a core 435 may be created. Additionally, a secondary path comprising the outermost portions of paths 401, 409, 407 and 411 may be created such that all other secondary and primary paths may be comprised within the core of the secondary path. Several smaller secondary paths may additionally comprise the interlocking braiding machine of FIG. 4 which may comprise cores 447, 449, 451 and 453. Subsequently, the six primary braiding machine paths may be interconnected resulting in portions of shared path 417, 419, 427, 425, 423, 421, 429, 431, 455, 457, 459 and 461.

As described herein, the interlocking braiding machine paths of FIG. 4 may be employed for the creation of a composite assembly. Such an assembly may be created through the insertion of preforms or core materials into the core of each primary and secondary path comprising the interlocking braiding machine of FIG. 4, Preforms may be inserted into cores of interlocking braiding machine paths at the same interval of time, as defined by the longitudinal length of the braided product, or different intervals in time. In an example of the interlocking braided structure formed by FIG. 4, a plurality of preforms may be inserted into cores 433, 435, 437, 439, 441, 443 and 445 during the braiding process. After the braiding process may be completed, a composite assembly of parts may be formed such that all components may be affixed to one another and which may not require secondary production processes to complete the assembly of parts. Such an assembly may be formed through shared portions of braiding machine track, or braided structure, between each primary and secondary braiding machine path comprising the interlocking braiding machine of embodiments herein.

Figure 5:
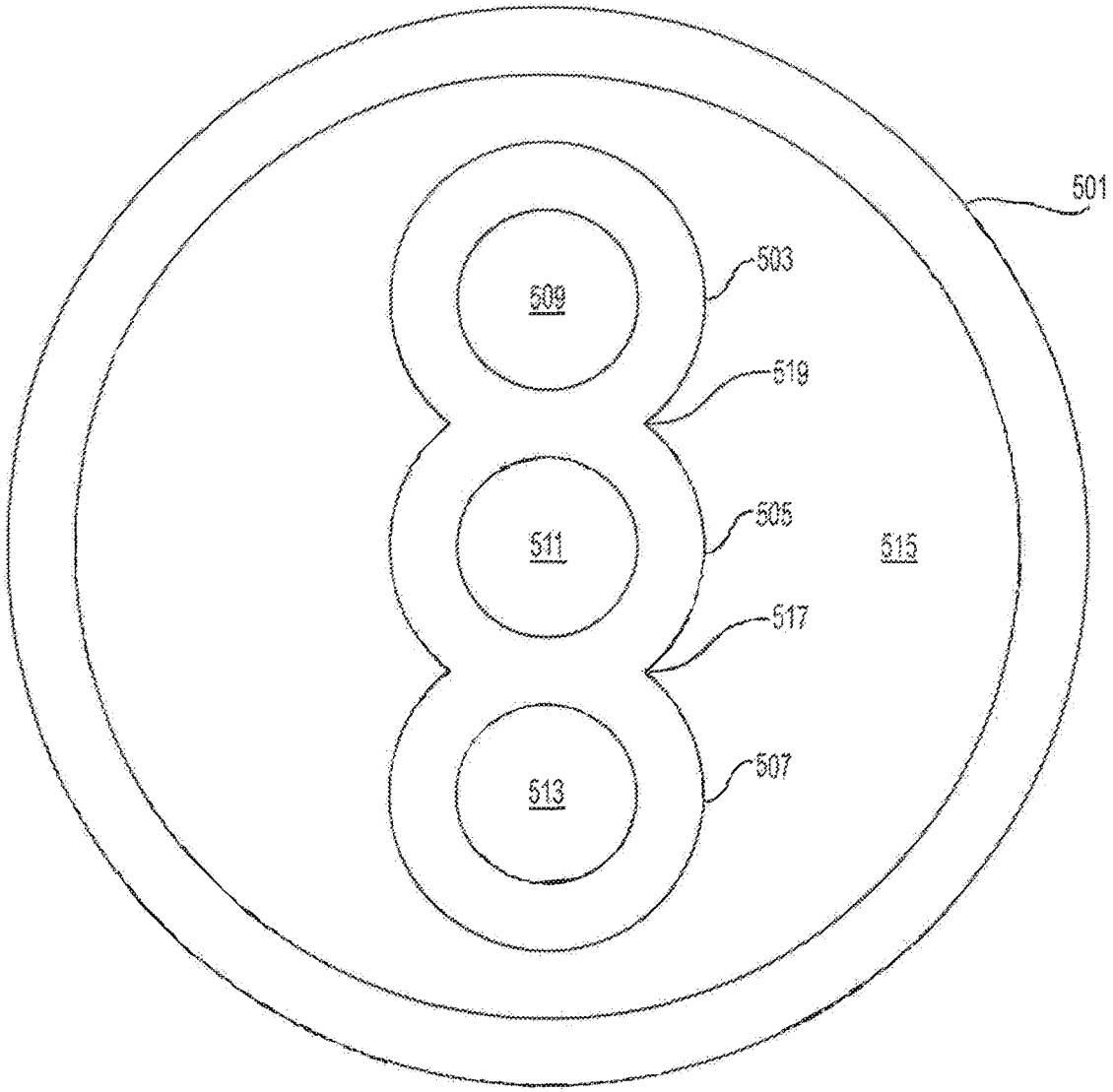
FIG. 5 illustrates a interlocking braided structure overbraided with a conventional tubular braided structure.

An additional embodiment of an interlocking braiding machine is illustrated in FIG. 5. FIG. 5 depicts an interlocking braided structure comprising paths 503, 505 and 507 affixed within the core 515 of path 501. The interlocking braided structure comprising paths 503, 505, and 507 additionally may comprise portions of shared path 519 and 517 as well as cores 509, 511 and 513. However, path 501 may not be interlocked with the interlocking braided structure comprising paths 503, 505, 507. In this manner, a conventional braided product may be overbraided over an interlocking braided structure. Additionally, preforms or core materials may be inserted into core 515, between path 501 and the interlocking braided structure comprising paths 503, 505 and 507, such that a composite assembly may be created which includes both a conventional braided product as well as an interlocking braided product.

As described in embodiments of the interlocking braided structure of the present subject matter an interlocking braided structure may be employed for the creation of composite assemblies as well as for the creation of composite structural members including pi, I and T shaped braided structures.

Figure 6B:
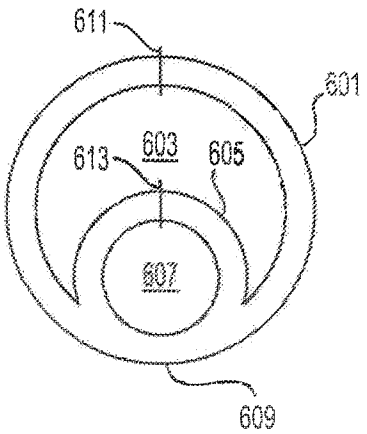
FIG. 6B illustrates how a braided structure formed by the interlocking braiding machine of FIG. 6A may be slit.
Figure 6A:
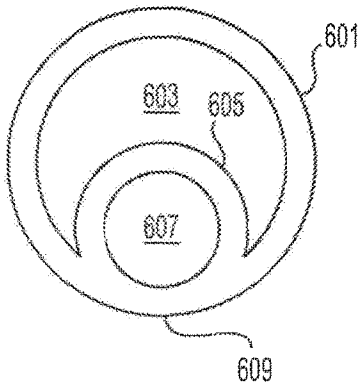
FIG. 6A illustrates a simple configuration of interlocking braiding machine paths for the formation of a pi shaped structural member.

The cross section of an interlocking braided structure, or configuration of interlocking braiding machine paths, which may be used for the formation of a pi shaped braided structure is illustrated in FIG. 6A. FIG. 6A comprises two primary paths, 601 and 605, each comprising a core, 603 and 607. Path 601 may allow for the creation of a first braided component, path 605 may allow for the formation of a second braided component while the portion of shared path 609 may allow for the formation of a transition braided component. Paths 601 and 607 share a portion of common track 609 such that the interlocking braided structure formed by the configuration of interlocking braiding machine paths of FIG. 6A may be joined at the location defined by the portion of shared path 609.

From hereinafter, paths 605, 601 and the portion of shared path 609 of FIGS. 6A-6C may also refer to the braided components formed along each path.

The braided product of FIG. 6A may be slit in specific locations as illustrated in FIG. 6B. The slitting locations may be defined by lines 611 and 613. Upon the slitting of an interlocking braided product, like that illustrated in FIGS. 6A-6B, the braided product may be unfolded such that a composite structural component as illustrated in FIG. 6C may be created. FIG. 6C illustrates the unfolding of FIGS. 6A-6B into a pi shaped structural member which may have particular utility in aerospace applications. As shown in FIG. 6C, the braiding components defined by paths 601 and 605, which were slit in FIG. 613 may be separated such that two halves of each of the interlocked braiding components defined by paths 601 and 605 may be created. The final braided structure may then be comprised of a total of 5 braided components, 601", 605", 605', 601' and 609. Braided components 605" and 605' may be formed through the slitting of the braided component of FIGS. 6A-6B defined by path 605. Further braided components 601" and 601' may be formed through the slitting of the braided component of FIG. 6B defined by path 601.

Figure 6C:
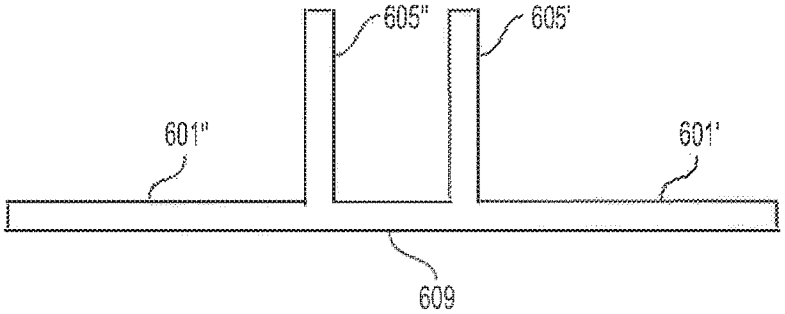
FIG. 6C illustrates how the slit interlocking braided structure of FIG. 6B may be unfolded for the creation of a pi shaped structural member.
Figure 7A:
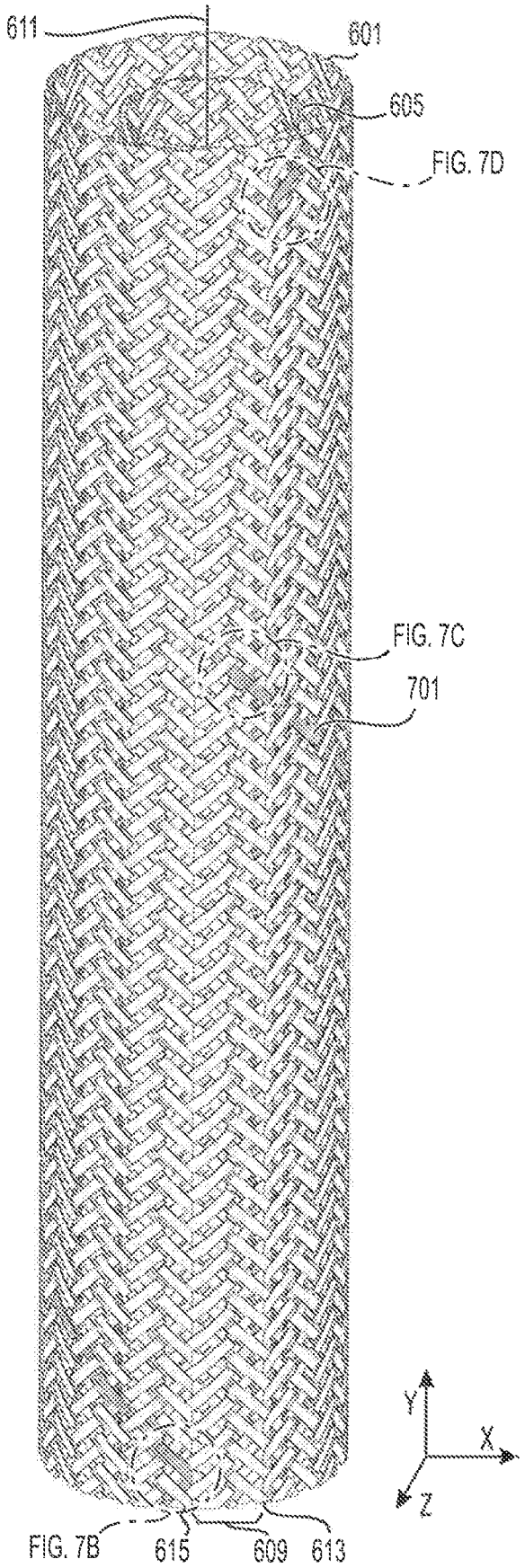
FIG. 7A is illustrative of the interlocking braided structure which may be formed by the interlocking braiding machine paths of FIG. 6A.

The braided structure of FIGS. 6A-6C is illustrated in FIG. 7A. The braided structure of FIG. 7A may comprise a first braided component including a first set of tows of the plurality of sets of tows intertwined with a second set of tows of the plurality of sets of tows, each of the first and second set of tows including a respective plurality of tows oriented to be substantially adjacent and parallel to each other at an angle relative to the longitudinal axis of the braided material. This angle may be defined as the bias angle with respect to the longitudinal axis as discussed in the specification herein. Each of the plurality of sets of tows may include a plurality of subsets of tows. The first braided component may be characterized by the braided structure formed by path 601 of FIG. 6A. Additionally, a second braided component, characterized by the interlocking braided structure formed by path 605 of FIG. 6A, may include a first subset of tows of the first set of tows intertwined with a second subset of tows of the first set of tows. In additional embodiments of the present subject matter, the second braided component further may include the first subset of tows of the first set of tows intertwined with at least one of the plurality of subsets of the second set of tows. Additionally, the second braided component may include, in embodiments herein, a third set of tows intertwined with at least one of the plurality of subsets of tows of the third set of tows.

Further, the braided structure of FIG. 7A may include the second set of tows which may include a third subset of tows and a fourth subset of tows. Further, the plurality of sets of tows further may include a third set of tows wherein the third set of tows may include a fifth subset of tows and a sixth subset of tows. Additionally, the second braided component further may include the first subset of tows intertwined with either one of the third subset of tows or the fifth subset of tows and the second subset of tows may be intertwined with either one of the fourth subset of tows or the sixth subset of tows. In an additional embodiment, the second braided component further includes each of the plurality of subsets of tows of the first set of tows intertwined with each of the plurality of subsets of tows of the second set of tows, and each of the plurality of subsets of tows of the second set of tows intertwined with each of the plurality of subsets of tows of the third set of tows.

The braided structure of FIG. 7A may further comprise in at least one repeating braiding pattern along the longitudinal axis, a transition braided component including at least one subset of tows from any of the plurality of sets of tows intertwined with at least one of the subsets of tows from any of the other ones of the plurality of sets of tows.

FIG. 7A illustrates the path of a single tow 701 as it may travel through varying positions along the longitudinal axis 611 of the braided structure. Further, FIG. 7A illustrates the first braided component 601, the second braided component 605 and the transition component 609 as described herein for the formation of a pi shaped structural component of FIGS. 6A-6C, as well as two intersections, 613 and 615.

Figure 7B:
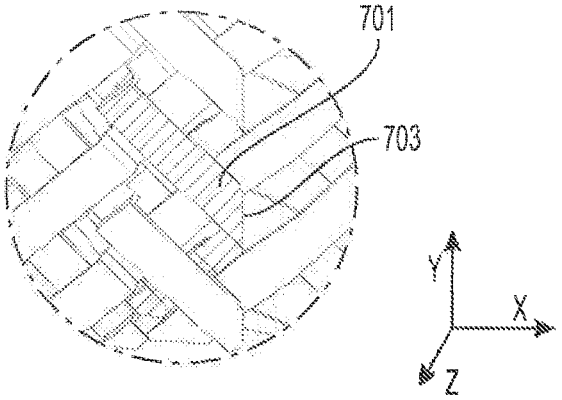
FIG. 7B is illustrative of a magnified view of the path of a single tow though the braided structure of FIG. 7A.
Figure 7C:
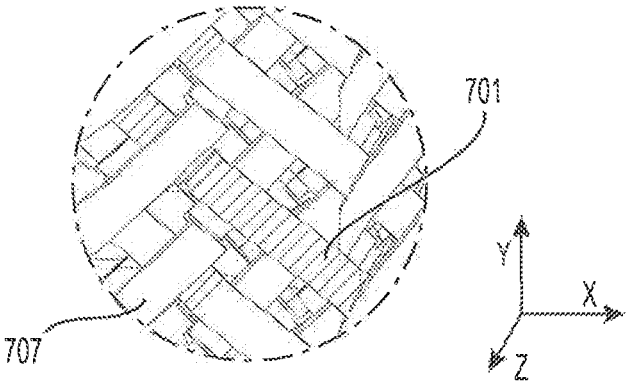
FIG. 7C is illustrative of a magnified view of the path of a single tow though the braided structure of FIG. 7A.
Figure 7D:
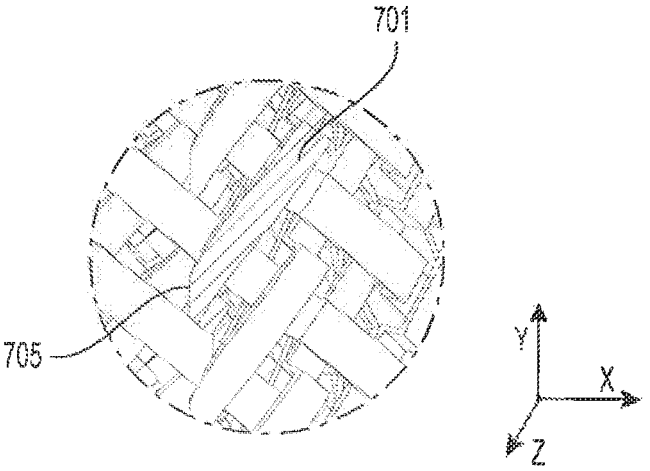
FIG. 7D is illustrative of a magnified view of the path of a single tow though the braided structure of FIG. 7A.

FIGS. 7B-7D additionally illustrate magnified views of the path of the tow 701 at three different positions along the longitudinal axis 611 of the braided structure as the tow may transition between the transition component 609 of the braided structure and the first 601 and second 605 braided components comprising the braided structure. FIG. 7D occurs at the earliest point in time as defined by the longitudinal length of the braided product of the present subject matter, while the formation of FIG. 7C occurs at a later interval of time and FIG. 7B occurs at a final, latest, interval of time as defined by the longitudinal length of the braided product illustrated in FIG. 7A.

FIG. 7B is illustrative of the path of the tow 701, at a first position along the longitudinal axis 611, at a first intersection 615 between the transition component 609 and the first 601 and second 605 braided components of FIG. 7A. At this intersection 615, the tow 701 may travel from the second braided component 605 and into the first braided component 601 by bending at 703. At this transition from the second braided component 605 to the first braided component 601, the tow 701 may not intertwine with tows comprising the transition braided component 609 and may only intertwine with tows of the second 605 and first 601 braided components.

FIG. 7C is illustrative of the path of the tow 701 at a second position along the longitudinal axis of the braided structure. At this position, the tow 701 may reach the intersection 613 between the first 601, second 605 and transitional 609 braided components and may continue across the intersection 613 and into the transitional braided component 609 until the intersection 615 may be reached. The tow may then continue across the intersection 615 traveling from the first braided component 601 to the second braided component 605. As the tow may cross the transition braided component 609 it may intertwine with tows of other subsets to from the braided structure of the transitional braided component 609. Additionally, at a later point in time defined by the longitudinal length of the braided structure, the tow 701 may cross the transition at s substantially opposing bias angle or in a different direction to that depicted in FIG. 7C.

FIG. 7D illustrates the path of the tow 701 at a third position along the longitudinal axis of the braided structure. At this position, the tow 701 may reach the intersection 613 between the first 601, second 605 and transitional 609 braided components and may travel from the second braided component to the first braided component, bending at 705. At this transition, the tow 701 may not intertwine with the tows of the transitional braided component 609 and may only intertwine with tows of the first 601 and second 605 braided components.

The transition of a single tow 701 between the first 601, second 605 and transitional 609 braided component as well as intersections 613 and 615 may alternate such that the tow may bend at a first position along the longitudinal length of the braided product in one bias direction in relation to the longitudinal axis from the second braided component 605 to the first braided component 601; may intertwine with tows of the transitional braided component 609 at a second position along the longitudinal length of the braided product in one bias direction in relation to the longitudinal axis 611 from the first braided component 601 to the second braided component 605; may bend at a third position along the longitudinal axis 611 from the second braided component 605 to the first braided component 601 in a different bias angle than that of the first position in relation to the longitudinal axis 611 of the braided structure; and may finally, intertwine with tows of the transitional braided component 609 at a fourth position along the longitudinal length of the braided product in a bias direction in relation to the longitudinal axis 611 different than that of the second position in relation to the longitudinal axis 611 of the braided structure.

Therefore, the braided structure of embodiments of the present subject matter may comprise at least two braided components with at least a first intersection 613 and a second intersection 615 between them at which all three braided components, 601, 605 and 609 meet. Further, the two braided components may comprise a first set of tows and a second set of tows intertwined in the first braided component 601 at different angles to the longitudinal axis 611 wherein at least some of the tows of the first set of tows may be configured to bend or, to be oriented at least partially around the intersection, at the first intersection 613 and may be oriented in the second braided component 605 at an angle different to an angle of at least some of the tows of the first set of tows in the first braided component 601. Additionally, the remaining tows of the first set of tows may be configured to cross from the first intersection 613 to the second intersection 615, through the transition braided component, and may be oriented in the second braided component 605 at substantially the same, or different, angle as the remaining tows of the first set of tows and the remaining tows of the first set of tows may be configured to be intertwined in the second braided component 609. In one exemplary embodiment, a braided material having a repeating braiding pattern along a longitudinal axis of the braiding material, with the braiding material including: a first set of tows including a plurality of tows being oriented to be substantially adjacent and parallel to each other at a first angle relative to the longitudinal axis, the first set of tows further including a plurality of subsets of tows; a first braided component and a second braided component, the first braided component including a plurality of intersections with the second braided component along the longitudinal axis, wherein a first intersection of the plurality of intersections is displaced from a second intersection of the plurality of intersections along a transverse line with respect to the longitudinal axis; at the first intersection, the first subset of tows is oriented at least partially around the first intersection and in the second braided component adjacent to the first intersection; and, at the second intersection, a second subset of tows of the first set of tows is configured to cross to the second intersection from the first intersection, wherein the second subset of tows is oriented in the second braided component adjacent to the second intersection. Further, in an alternative embodiment, the second braided component includes the first subset of tows intertwined with the second subset of tows. In another alternative embodiment, the braided material further comprising: a second set of tows including a plurality of tows being oriented to be substantially adjacent and parallel to each other at a second angle relative to the longitudinal axis, the second set of tows further including a plurality of subsets of tows; at the second intersection, the third subset of tows is oriented at least partially around the second intersection and in the second braided component adjacent to the second intersection; and at the first intersection, a fourth subset of tows of the second set of tows is configured to cross to the first intersection from the second intersection, wherein the fourth subset of tows is oriented in the second braided component adjacent to the first intersection. Further, in an alternative embodiment, between the first intersection and the second intersection, the fourth subset of tows intertwines with the second subset of tows.

Figure 8:
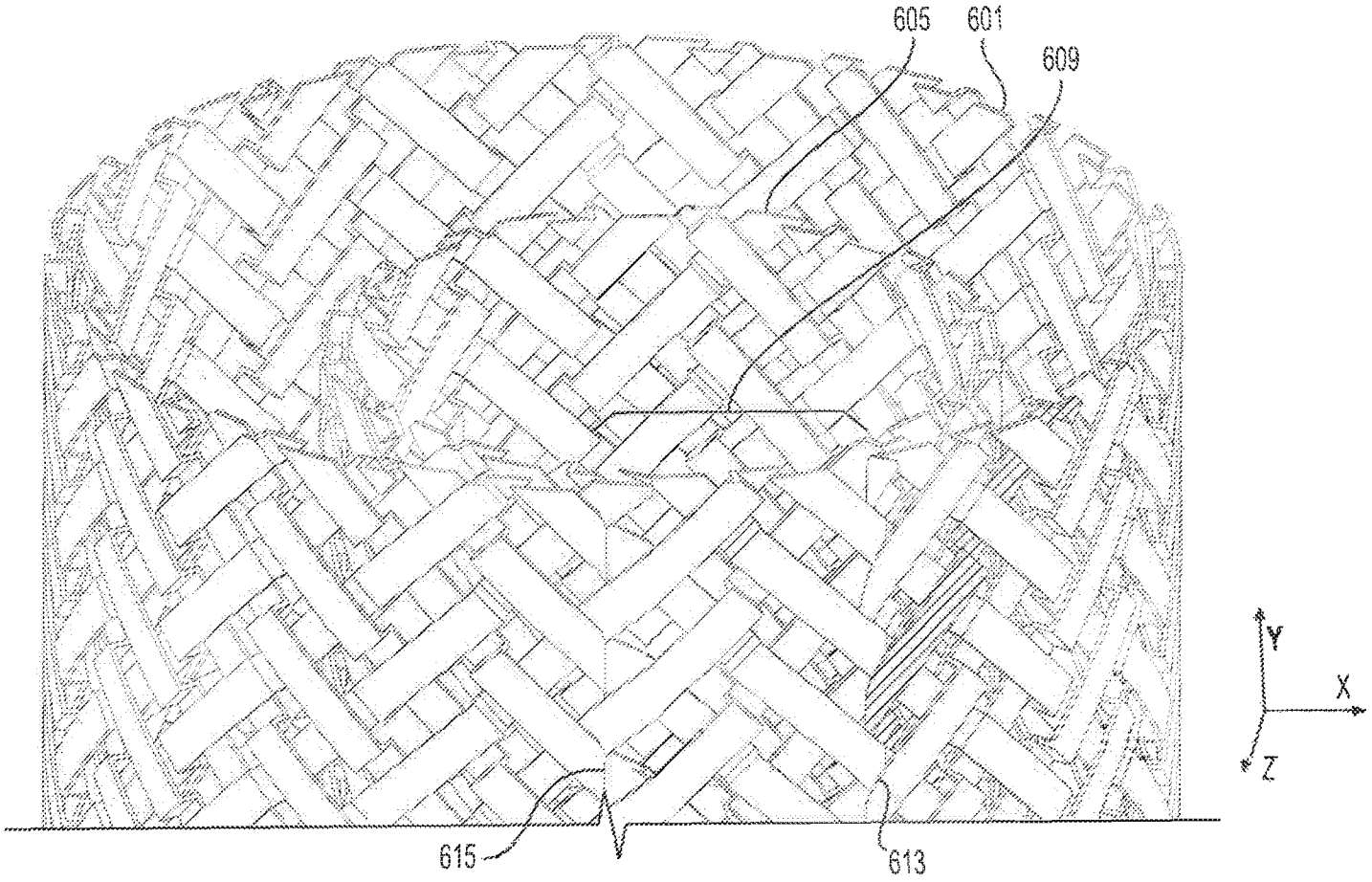
FIG. 8 illustrates a magnified view of the top of the interlocking braided structure of FIG. 7A.

FIG. 8 is additionally illustrative of the three braided components comprising an interlocking braided structure for the formation of a pi shaped braided structure as illustrated in FIGS. 6A-6C. FIG. 8 depicts a magnified view of the top of the braided structure in which the first braided component 601 may be interlocked with the second braided component 605 through the intertwining of tows within the transition braided component 609.

While the interlocking braided structure for the formation of a pi shaped braided structure as illustrated in FIGS. 6A-6C has been discussed in embodiments of the present subject matter as comprised of three sets of tows, each comprising at least two subsets, for the formation of a biaxial braided structure, an additional three sets of tows may also comprise the braided components of the braided structure of embodiments herein such that each additional set of tows may comprise axial tows for the formation of a triaxial interlocking braided structure, in fourth, fifth and sixth sets of tows. A top down view of a triaxial braided structure of embodiments of the interlocking braided structure of the present subject matter is illustrated in FIG. 9.

Figure 9:
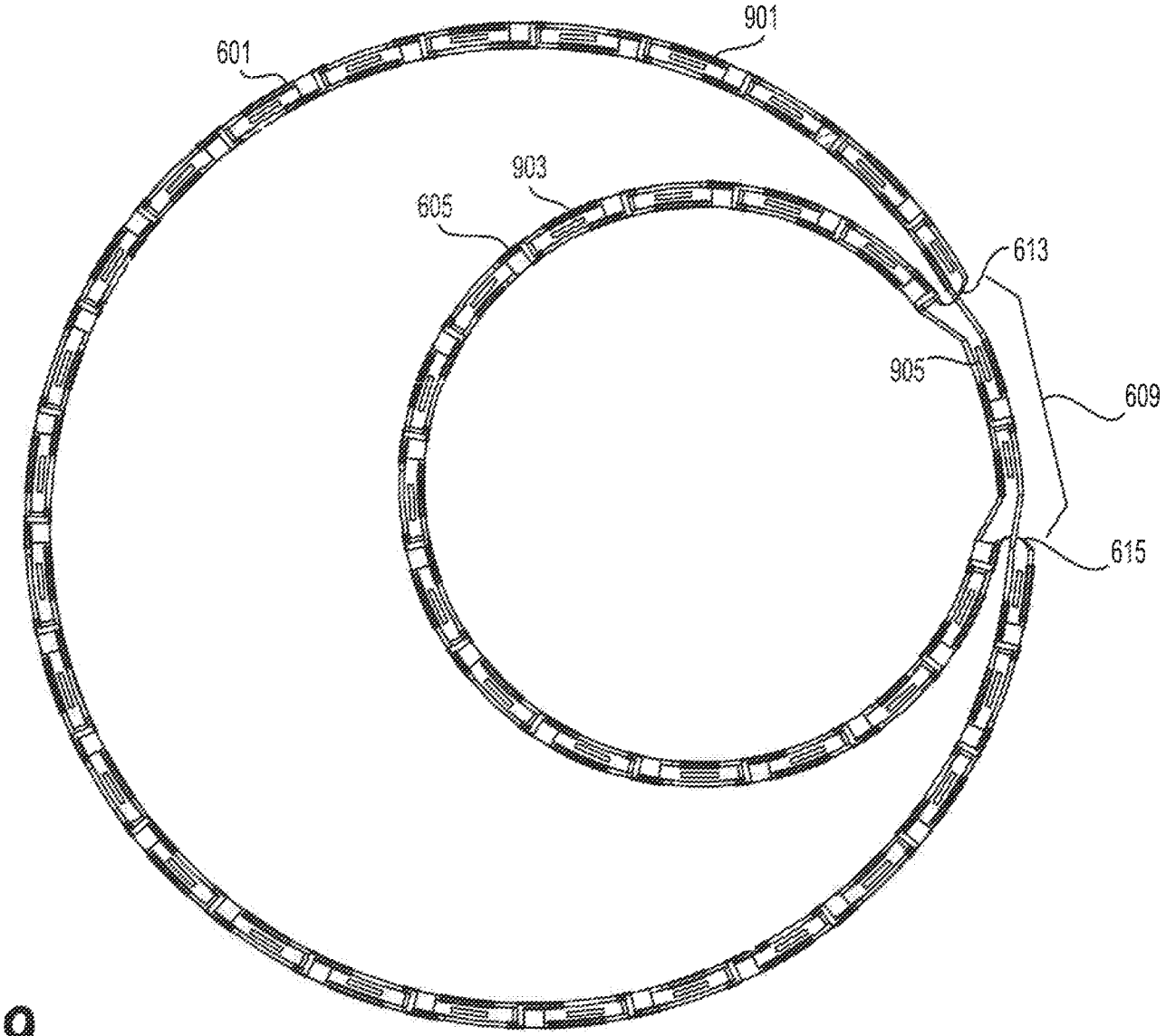
FIG. 9 is illustrative of a top view of the braided structure of FIG. 7A which shows the inclusion of axial tows.

FIG. 9 illustrates the first braided component 601 of the present subject matter comprised of both bias and axial tows such that the circumference of the first braided component 601 may be comprised of bias tows while axial tows 901 may be inserted into the braided structure such that the axial tows 901 may be oriented along the longitudinal axis of the braided structure. Therefore, the first braided component may comprise a first set of tows intertwined with a second set of tows and a fourth set of tows 901. Additionally, FIG. 9 illustrates the second braided component 605 of the present subject matter comprised of both bias and axial tows 903 such that the bias tows may form the circumference of the second braided component 605 while axial tows 903 may be inserted into the braided structure such that the axial tows may be oriented along the longitudinal axis of the braided structure. Therefore, the second braided component may comprise a first subset of tows of the first set of tows intertwined with a second subset of tows of tows of the first set of tows and a fifth set of tows 903. Finally, the transition braided component of the present subject matter may comprise both bias and axial tows such that the bias tows form the circumference of the transitional braided component 609 and such that axial tows 905 may be inserted into the braided structure such that the axial tows 905 may be oriented along the longitudinal axis of the braided structure. Therefore, the transitional braided component 609 may comprise at least one subset of tows from any of the plurality of sets of tows intertwined with at least one of the subsets of tows from any of the other ones of the plurality of sets of tows and a sixth set of tows 905.

Figure 10:
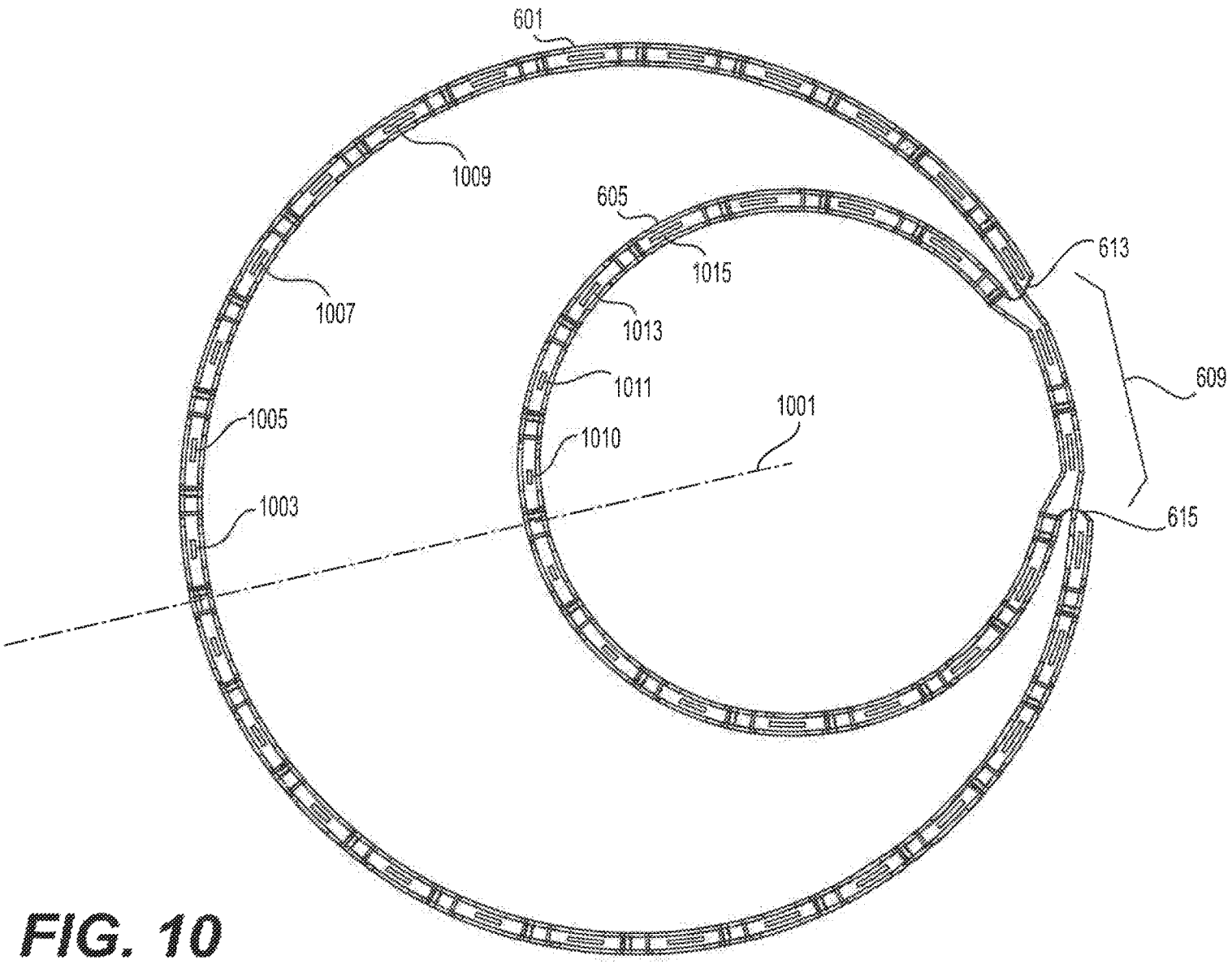
FIG. 10 illustrates a top view of the braided structure of FIG. 7A in which the widths of axial tows have been varied.

As described in FIG. 6B, the interlocking braided structure of embodiments of the present subject matter maybe slit along the longitudinal axis to create a pi shaped structural member. FIG. 10 illustrates the interlocking braided structure of FIG. 6A depicting a line 1001 along which the braided structure of the present subject matter may be slit to form the pi shaped structural member of embodiments of the present subject matter. Further, FIG. 10 illustrates an additional embodiment of a triaxial interlocking braided structure of embodiments of the present subject matter. The numbers or types of axial tows comprising the fourth and fifth sets of tows of the braided structure of embodiments of the present subject matter may be varied such that a decrease in tow width may occur within the braided structure such that tows closest to the slit line 1001 may be of the smallest width while tows farthest from the slit line may be of greater width. As illustrated in FIG. 10, axial tows 1003, closest to the slit line 1001 may be of the smallest axial tow width, axial tows 1005 may be of increased tow width, axial tows 1007 may additionally comprise increased tow width and finally axial tows 1009 may comprise a further increased tow width. This same decrease of axial tow width may be observed in the second braided component 605 in which the axial tow width decreases such that the smallest axial tow width may occur for axial tows 1010 and may increase through tows 1011, 1013 and 1015 all positioned at varying radial distances from the slit line 1001. The transitional braided component 609 of embodiments of the braided structure of the present subject matter may additionally comprise varying tow widths in embodiments of the present subject matter.

Figure 11:
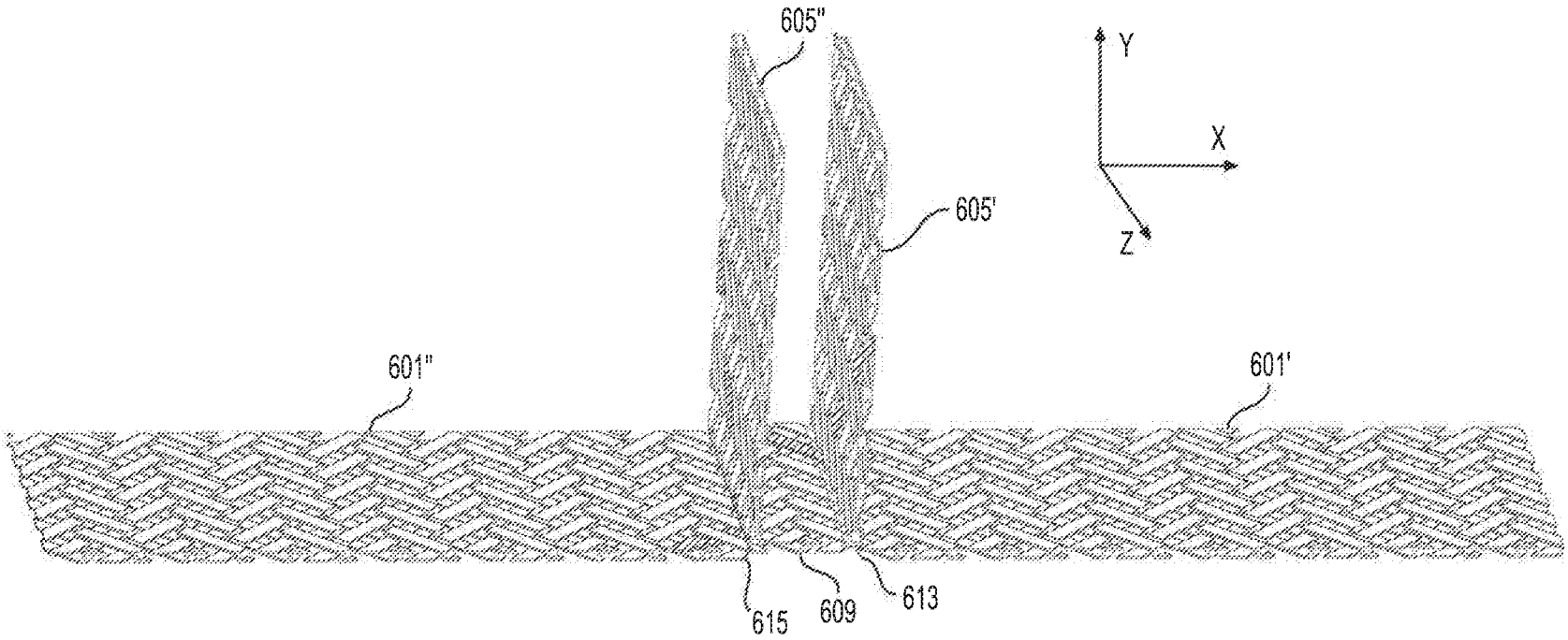
FIG. 11 illustrates the pi shaped structural member of FIG. 6C.

As shown in FIGS. 6B and 10, the braided structure of embodiments of the present subject matter for the formation of a pi shaped structural member may be slit such that the pi shaped structural member may be obtained. The braided structure of FIG. 6C which has been slit is depicted in FIG. 11. FIG. 11 illustrates the division of the first 601 and second 605 braided components into a plurality of braided components, 601', 601",605' and 605". After slitting, the first braided component 601 may be divided into two halves, 601' and 601" while the second braided component 605 may also be divided into two halves, 605' and 605". The transitional braided component 609 in embodiments of the present subject matter may be maintained after slitting. In addition, regarding the second braided component shown in FIG. 10, in one embodiment, In one embodiment, the second braided component includes a plurality of axial tows being substantially parallel to the longitudinal axis and interlaced into the first subset of tows intertwined with the second subset of tows. In a further embodiment, the plurality of axial tows includes a first axial tow having a first tow width and a second axial tow having a second tow width; and, the second braided component including at least one of the first axial tow and at least one of the second axial tow, wherein the first two width is different than the second tow width.

Figure 12:
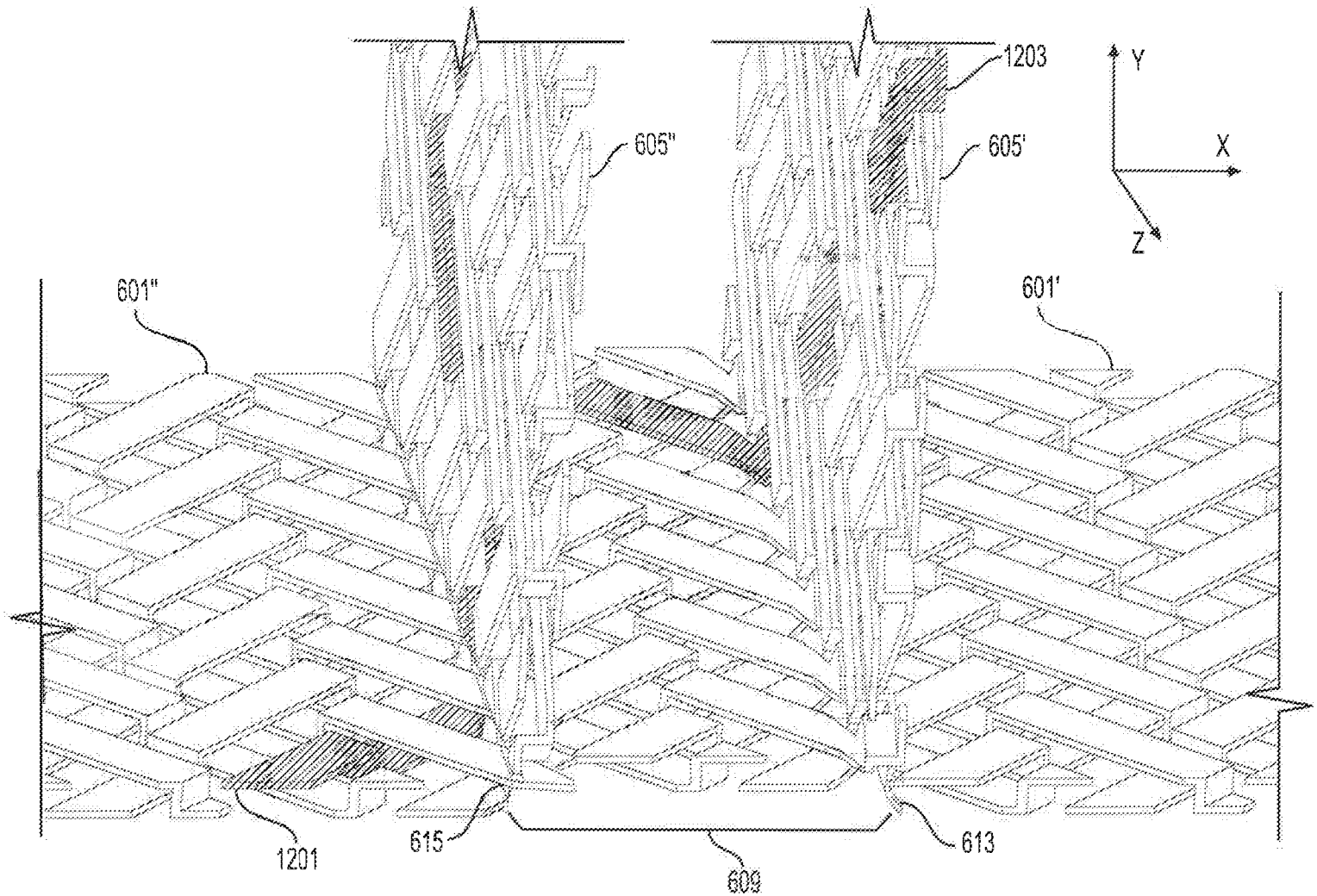
FIG. 12 illustrates a magnified view of the intersection of braided components comprising the pi shaped structural member of FIG. 11.

FIG. 12 illustrates a magnified view of the intersections, 613 and 615, at which all five braided components of the slit pi shaped interlocking braided structure, 601", 601', 605", 605' and 609, meet. Two tows 1201 and 1203 within the pi shaped interlocking braided structure of FIG. 12 have been highlighted to illustrate paths of tows within the slit pi shaped interlocking braided structure. Tow 1201 is illustrative of a tow which, in the non-slit interlocking braided structure of FIGS. 6A-10 may have transitioned from the second braided component 605 to the first braided component 601 and which in the slit interlocking braided structure may transition from braided component 605" to 601", or from halves of the first 601 and second 605 braided components. Additionally tow 1203 is illustrative of a tow which in the non-slit interlocking braided structure of FIGS. 6A-10 may have transitioned from the first braided component 601, through the transition braided component 609 and into the second braided component 605. Within the slit pi shaped interlocking braided structure; the tow 1203 may transition from braided component 601' through the transition braided component 609 and into the braided component 605'.

The braided structure of the present subject matter may comprise a first braided component which may include a first set of tows intertwined with a second set of tows at a first angle, or bias angle, relative to the longitudinal axis and a second braided component which may include a first subset of tows intertwined with the second subset of tows at a second angle, or bias angle, relative to the longitudinal axis, wherein the first angle and the second angle may be substantially the same. Further, in embodiments of the present subject matter, the first angle may be different from the second angle. In another embodiment, In an alternative embodiment, the first braided component further includes the first set of tows intertwined with the second set of tows at a first angle relative to the longitudinal axis; and, the second braided component further includes the first subset of tows intertwined with the second subset of tows at a second angle relative to the longitudinal axis, wherein the first angle and the second angle are substantially the same. In another embodiment, the first braided component further includes the first set of tows intertwined with the second set of tows at a first angle relative to the longitudinal axis; and, the second braided component further includes the first subset of tows intertwined with the second subset of tows at a second angle relative to the longitudinal axis, wherein the first angle is different than the second angle.

The braided structure of the present subject matter, may further comprise a transition braided component which may include at least one subset of tows from any of the plurality of sets of tows which may be intertwined with another one of the subsets of tows from any of the other ones of the plurality of sets of tows at a third angle relative to the longitudinal axis, wherein the third angle may be substantially the same as one or both of the first or second angle of the first or second braided components, or the first angle may be different than the second angle and the third angle may be different than each of the first angle and the second angle. The relationships between the first, second and third angle may be altered depending upon the braid unit cells in the braided components.

The braided structure of the present subject matter may additionally comprise a plurality of intersections such that an intersection may be defined as the location at which a plurality of braided components comprising an interlocking braided structure may meet. In an example, the braided structure of FIG. 7A may comprise two intersections wherein a first intersection 615 may be located to the right of the transition braided component and a second intersection 613 may be located to the left of the transition braided component.

Figure 13A:
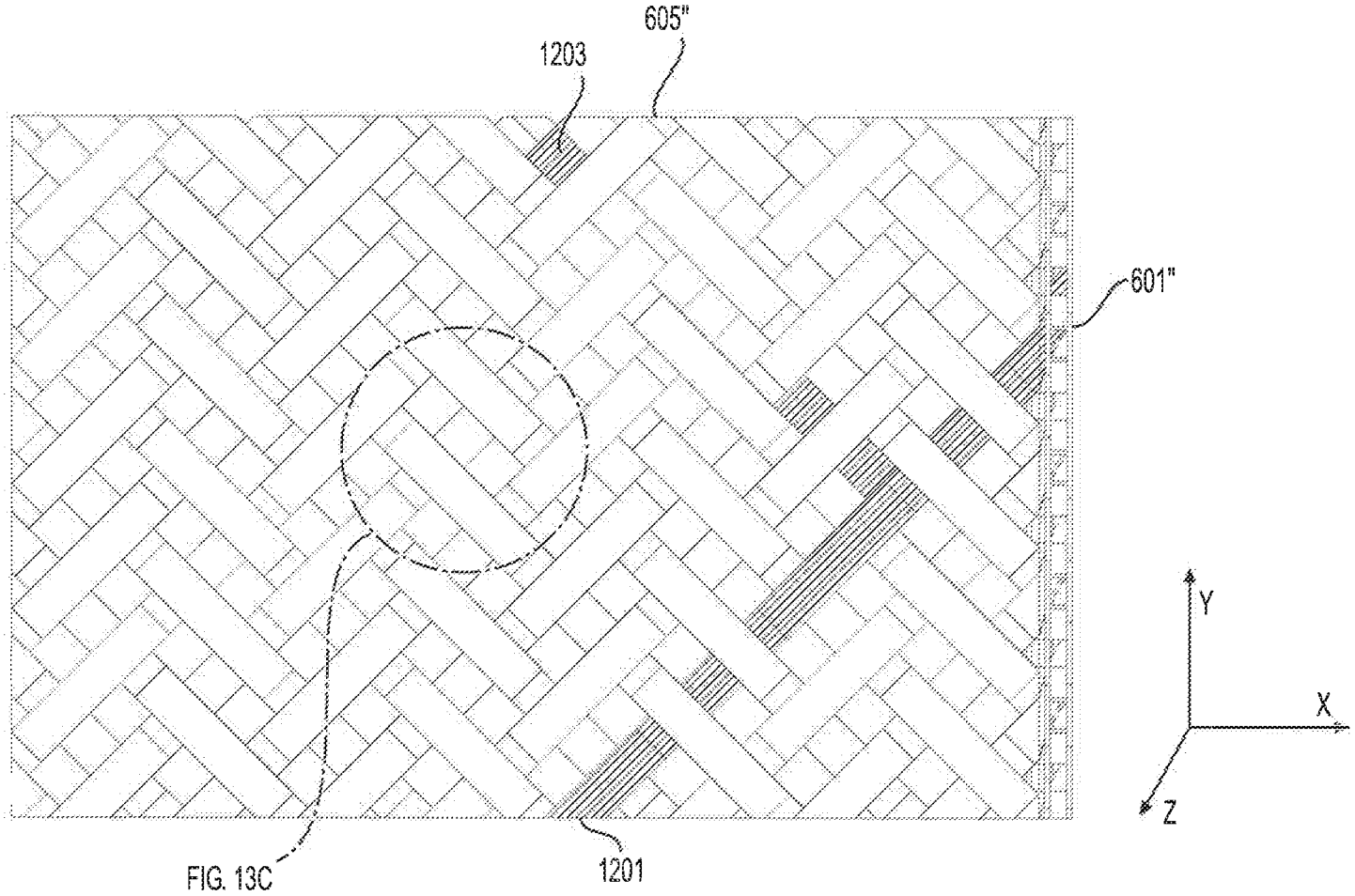
FIG. 13A illustrates a side view of the pi shaped structural member of FIG. 11.
Figure 13B:
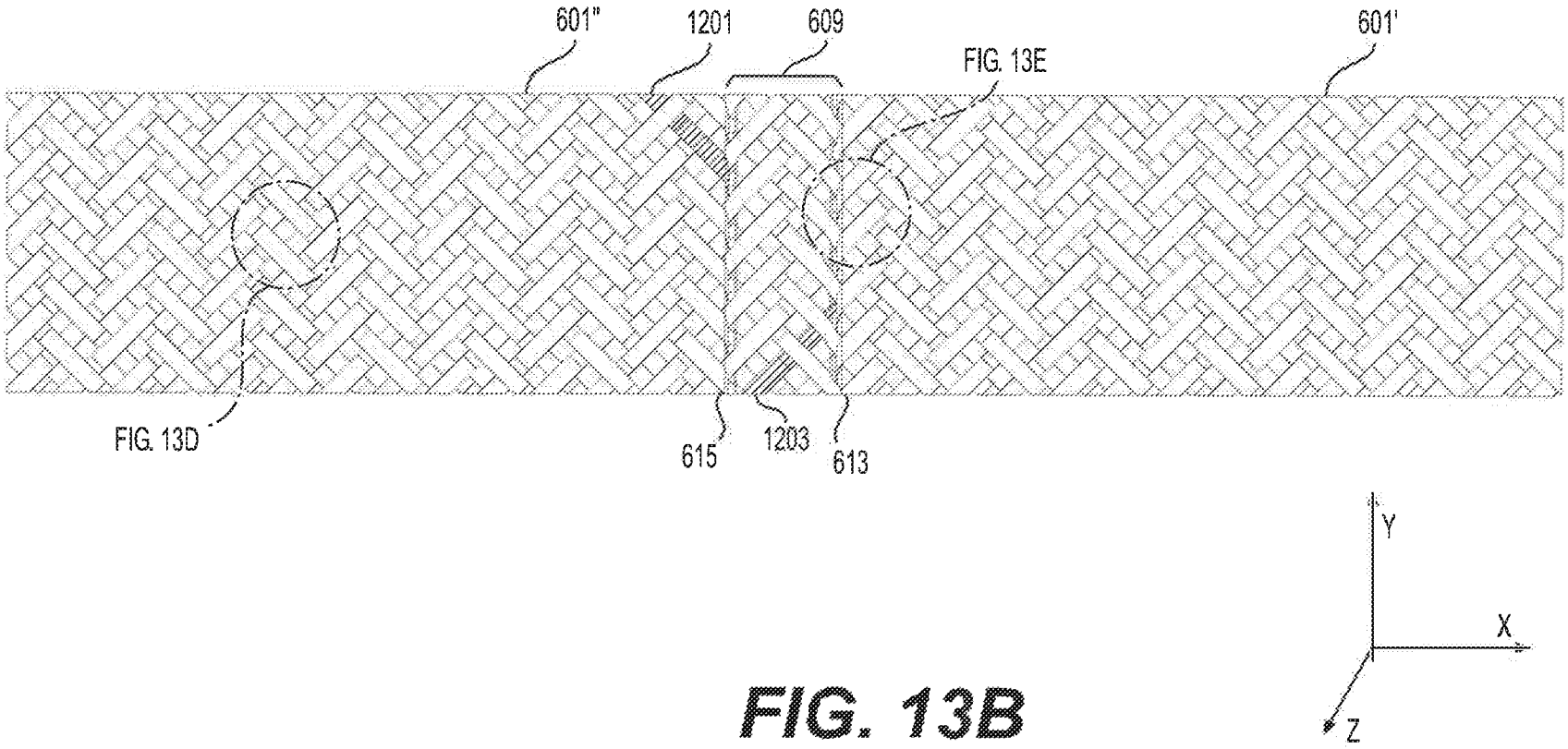
FIG. 13B illustrates a bottom view of the pi shaped structural member of FIG. 11.

FIG. 13A is illustrative of a side view of the pi shaped braided structure of embodiments of the present subject matter shown such that 601" is oriented along the Z axis and 605" is oriented along the X axis. FIG. 13B is illustrative of a bottom view of the pi shaped braided structure of embodiments of the present subject matter depicted such that 601" and 601' are oriented along the X axis and 605' and 605" are oriented along the Z axis.

The first 601 and second 605 braided components of FIGS. 6A-6B and 7A-10 as well as the transitional component 609 of the interlocking braided structure of embodiments herein may each comprise a unit cell, or a minimum number and pattern of tows to uniquely characterize each braided component. Each of the braided components may comprise generally the same unit cell or different unit cells in embodiments of the present subject matter. Therefore, upon the slitting of the interlocking braided structure of embodiments of the present subject matter, braided components 601' and 601" may generally comprise the same unit cell, braided components 605' and 605" may generally comprise the same unit cell and the transitional component may additionally comprise at least one unit cell. Further, the unit cells of 601', 601", 605' and 605" may generally be the same. However, the unit cell comprising the transitional braided component 609 may be unique and may comprise a series of unit cells. The unit cell of the transitional braided component 609 may differ from the unit cells of the braided components, 601', 601", 605' and 605", formed through the slitting of the first 601 and second 605 braided components.

Figure 13E:
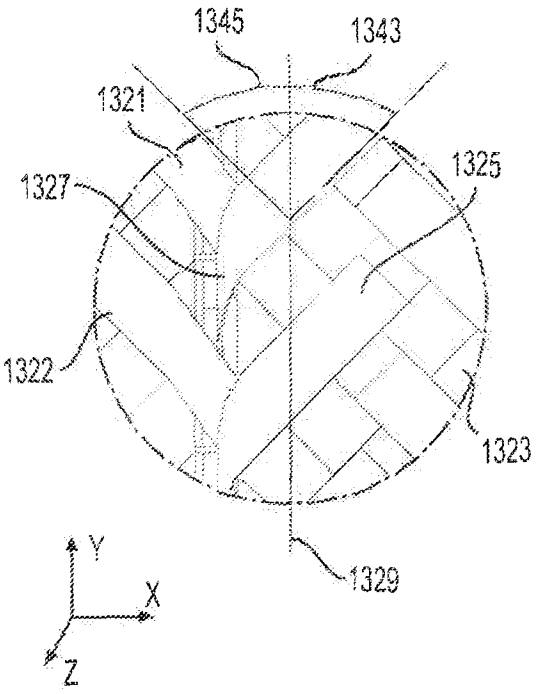
FIG. 13E illustrates the unit cell of a transitional braided component comprising the pi shaped structural member of FIG. 11.
Figure 13D:
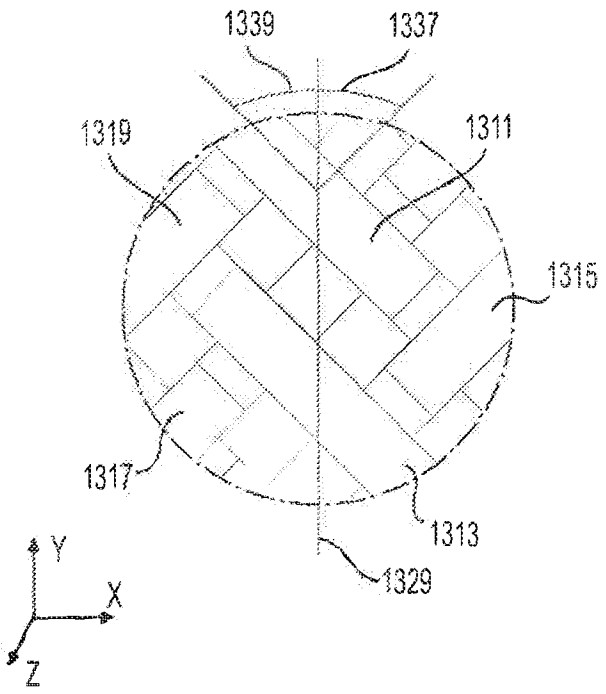
FIG. 13D illustrates the unit cell of a second braided component comprising the pi shaped structural member of FIG. 11.
Figure 13C:
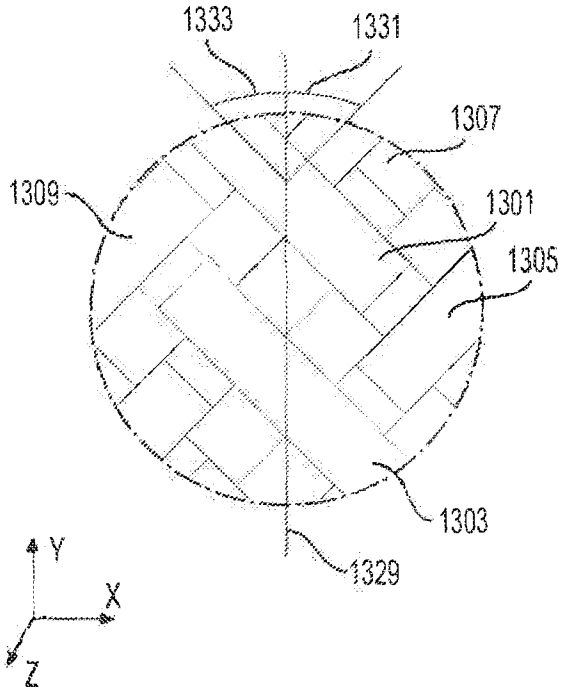
FIG. 13C illustrates the unit cell of a first braided component comprising the pi shaped structural member of FIG. 11.

The unit cell of braided component 605", and therefore the second braided component 605, is illustrated in FIG. 13C. As described herein a 2×2 braided structure may comprise at least five tows to uniquely characterize the braided structure, therefore the unit cell of braided component 605" may comprise at least five tows, 1301, 1303, 1305, 1307 and 1309. Within this unit cell, tow 1303 may pass over two tows, 1305 and 1307, while tow 1307 may pass under two tows, 1303 and 1301. Tow 1309 may be required to complete the unit cell such that tow 1303 may begin to pass under an additional two tows starting with tow 1309. Tows comprising the unit cell of braided component 605" may be oriented in positive 1331 and negative 1333 bias angles with respect to the longitudinal axis 1329 of the braided structure of the present subject matter such that tows 1301 and 1303 may be oriented at negative bias angles 1333 to the longitudinal axis 1329 of the braided structure while tows 1307, 1305 and 1309 may be oriented at positive bias angles 1331 with respect to the longitudinal axis.

The unit cell of braided component 601", and therefore the first braided component 601 is illustrated in FIG. 13D in which five tows, 1311, 1313, 1315, 1317 and 1319 may be required to uniquely characterize the braided 2×2 braided structure. Within this unit cell tow 1313 may pass over two tows, 1315 and 1317, while tow 1317 may pass under two tows, 1311 and 1313. Tow 1319 may be necessary to complete the unit cell such that tow 1313 may begin to pass under an additional two tows starting with tow 1319. The tows comprising the unit cell of braided component 601" may be oriented at positive 1337 and negative 1339 bias angles with respect to the longitudinal axis 1329 of the braided structure such that tows 1311 and 1313 may be oriented at negative bias angles 1339 with respect to the longitudinal axis 1329 and tows 1319, 1317 and 1315 may be oriented at positive bias angles 1337 with respect to the longitudinal axis.

In embodiments of the braided structure of the present subject matter the positive, 1331 and 1337, and negative, 1333 and 1339, bias angles of braided components 601" and 605" may be substantially the same. However, in additional embodiments of the present subject matter, the bias angles of braided components 601" and 605" may be different such that when a tow may transition from one braided component to the other braided component a change in bias angle of the tow may be induced.

The unit cell of the transitional braided component 609, illustrated in FIG. 13E, may differ from the unit cells of braided component 601" and braided component 605" such that the transitional braided component may comprise tows of braided components 601" and 605"; the unit cell of the transitional braided component may be influenced by the unit cells of braided components 601" and 605"; the unit cell of the transitional braided component 609 may only be repetitive along the longitudinal axis 1329 of the braided structure: and such that the unit cell of the transitional braided component may be variable in the transverse direction of the braided stricture.

The transitional braided component unit cell of FIG. 13E may comprise tows 1322, 1321, 1327, 1325 and 1323. Tows 1321 and 1322 may be comprised within the transitional braided component 609 while tows 1327, 1325 and 1323 may be comprised within braided component 601'. Within the transitional braided component unit cell illustrated in FIG. 13E, tow 1321 may pass under two tows, 1327 and 1325, while tow 1325 may pass over two tows, 1322 and 1321. Tow 1323 may be required to create a complete units cell such that tow 1321, which may pass under tows 1327 and 1325 may begin to pass over two tows beginning with tow 1323. Within the transitional braided component unit cell, tows 1321 and 1322 may be oriented at negative bias angles 1345 with respect to the longitudinal axis 1329 while tows 1327, 1325 and 1323 may be oriented at positive bias angles 1343 with respect to the longitudinal axis 1329. The positive 1343 and negative 1345 bias angles of the transitional braided component unit cell may be substantially the same as the unit cells of braided components 601" and 605" if the bias angles of braided components 601" and 605" may be substantially the same.

In an example of the present subject matter in which the bias angle of braided components 601" and 605" may be substantially the same, tows participating in the transitional unit cell may transition into braided components comprising the braided structure in substantially the same bias angle and therefore the transitional braided component unit cell may comprise substantially the same bias angles as braided components 601" and 605". However, if the bias angles between braided components 601" and 605" may be different, tows comprising the transition braided component unit cell may comprise different bias angles with respect to both braided components 601" and 605" such that tows between each of braided components 601" and 605" may be transitioned from one bias angle to another bias angle. Therefore, the bias angle of the transitional unit cell may be influenced by the bias angles of braided components 601" and 605".

Further, the transitional unit cell of embodiments of the present subject matter may vary across the transitional braided component such that multiple unit cells may comprise the transitional unit cell of the present subject matter. Additionally, each unit cell may be repetitive along the longitudinal axis of the braided structure. In an example of FIG. 13E, the illustrated unit cell may be repeated along the longitudinal axis. If the unit cell were to be repeated in the transverse direction the unit cell may not characterize the braided structure at a location transverse to the original location. Therefore the transitional braided component may comprise at least an additional unit cell transverse to the unit cell of FIG. 13E.

Additionally, the unit cell may comprise a three dimensional element as illustrated in FIG. 13E. In FIG. 13E tows 1322 and 1321 may be oriented along the X axis. However, tows 1327, 1325 and 1323 may comprise sections which are oriented along the X axis and the Z axis as the tows may transition from braided component 601' to braided component 605'.

Figure 13F:
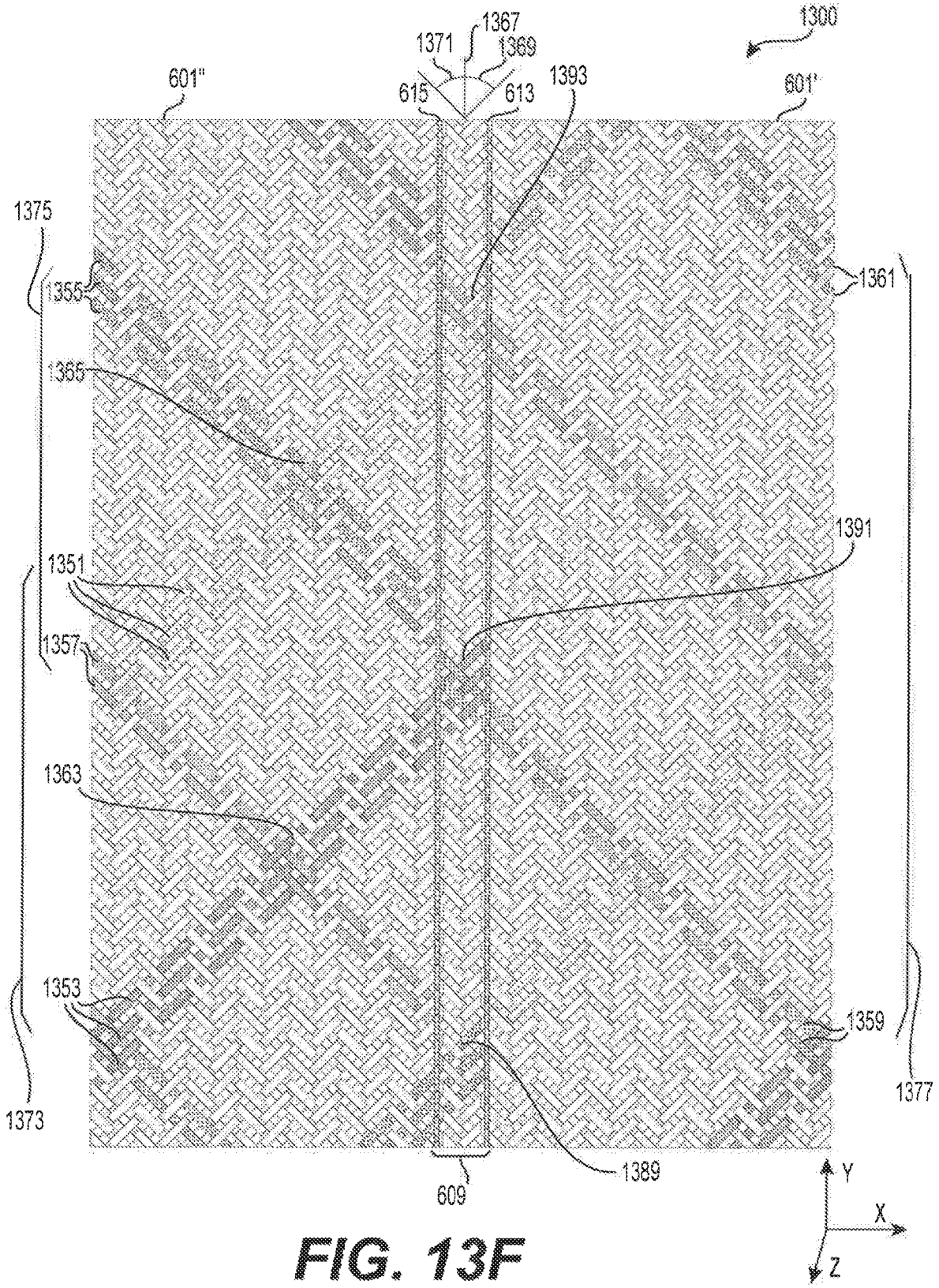
FIG. 13F illustrates a top view of a long pi shaped structural member depicting the intertwining of sets of tows.
Figure 13G:
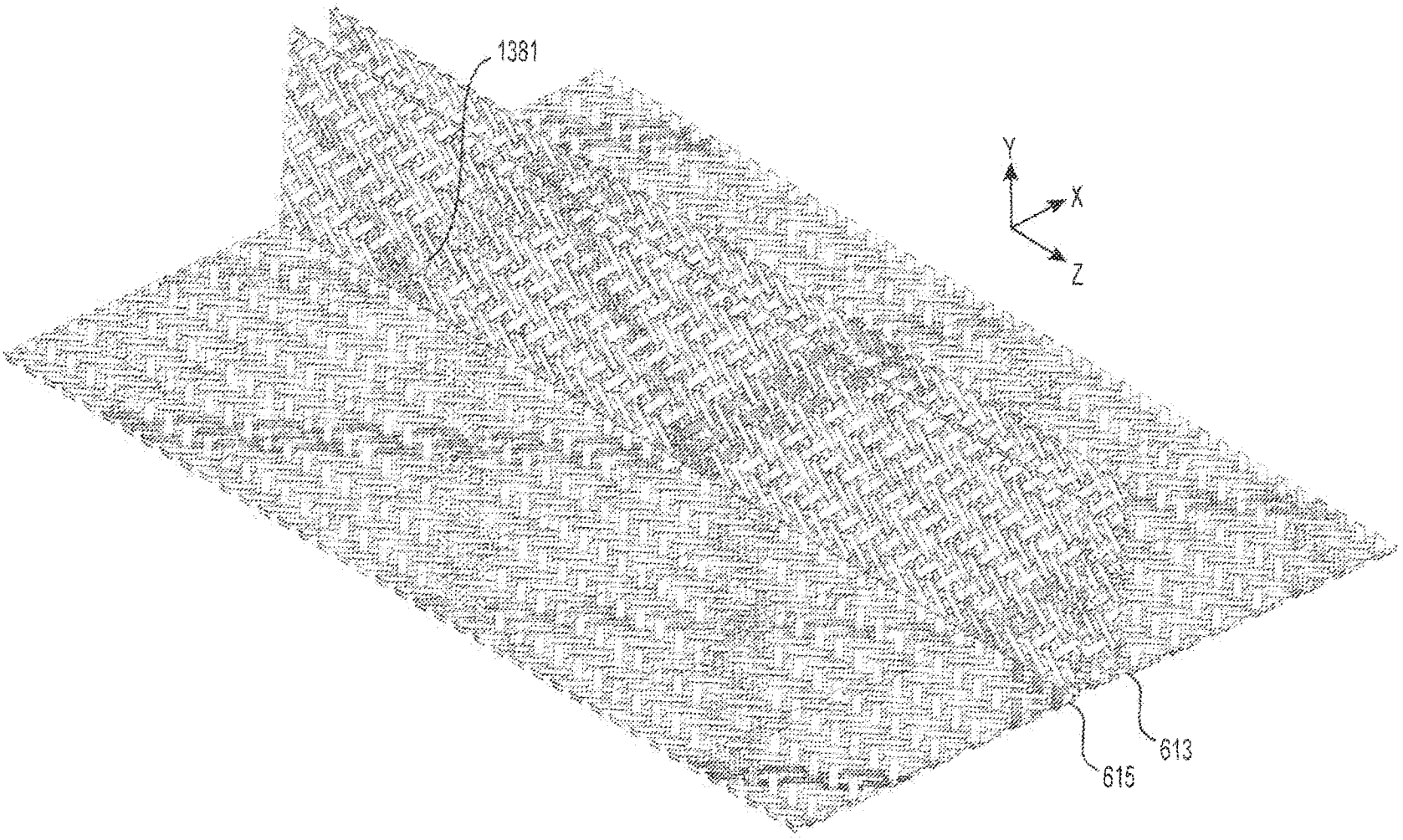
FIG. 13G illustrates an angled view of the long pi shaped structural member of FIG. 13F.
Figure 13H:
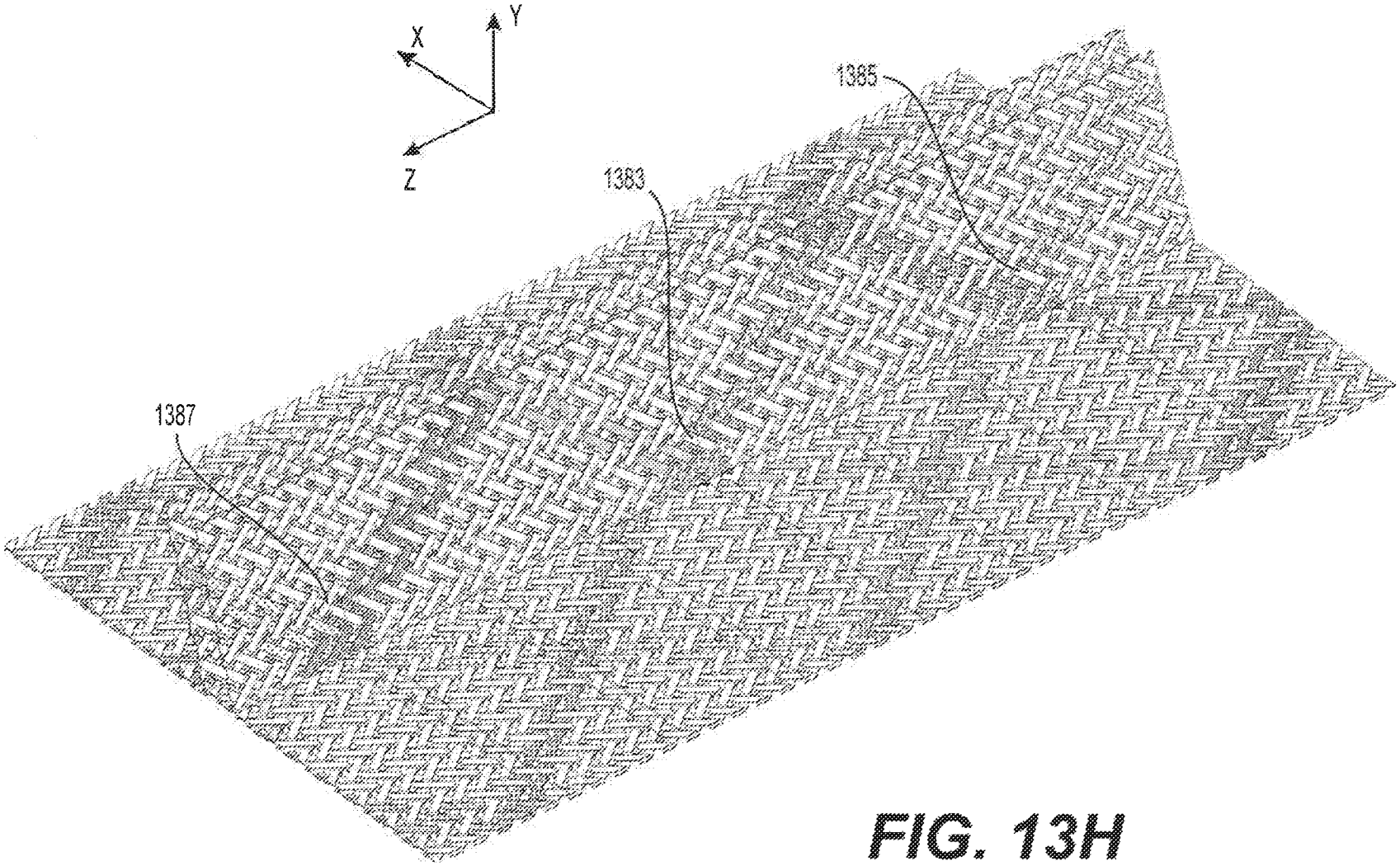
FIG. 13H illustrates an additional angled view of the long pi shaped structural member of FIG. 13F.

Discussion of the pi shaped braided structure of the present subject matter may now turn to FIGS. 13F-13H. For discussion purposes of FIGS. 13F-13H the first braided component may be referred to as 601" and the second braided component may be referred to as 605". Further, as described herein braided components 601' and 605' may be described as the mating halves to braided components 601" and 605" comprising the non-slit interlocking braided structure. Further, the tow set composition and tow subset transition pattern within the final braided product may be discussed in relation to the braided components comprising the finished, slit pi shaped braided structure, 601', 601", 605', 605" and 609.

As described in embodiments of the pi shaped interlocking braided structure 1300 discussed herein, the braided structure may be comprised of a plurality of sets of tows 1373, 1375 and 1377, wherein each set of tows 1373, 1375 and 1377, may include a plurality of tows being oriented to be substantially adjacent and parallel to each other at an angle, 1369 and 1371, relative to a longitudinal axis 1367 of the braided structure wherein each of the plurality of sets of tows, 1373, 1375 and 1377 may include a plurality of subsets of tows 1351, 1353, 1355, 1357, 1359 and 1361, wherein in at least one repeating braiding pattern along the longitudinal axis 1367, a first braided component 601" may include a first set of tows 1373 of the plurality of sets of tows intertwined with a second set 1375 of a plurality of tows.

Additionally, the first braided component 601" may be comprised of a first set of tows 1373 intertwined with a second set of tows 1375. Further, the second braided component 605" may include a first subset of tows 1351 of the first set of tows 1373 intertwined with a second subset of tows 1353 of the first set of tows 1373. The second set of tows 1375 may include a third 1355 and fourth 1357 subset of tows and the plurality of tows may include a third set 1377 of tows wherein the third set of tows 1377 may include a fifth subset of tows 1359 and a sixth subset of tows 1361 and the second component 605 further may include the first subset of tows 1351 intertwined with either one of the third subset 1355 or the fifth subset 1359 of tows and the second subset 1353 of tows intertwined with either one of the fourth subset 1357 or the sixth subset 1361 of tows.

The braided structure of embodiments of the present subject matter may further comprise a plurality of braided components, 601" and 605", such that each of the plurality of braided components, 601" and 605", may include at least one intersection, 615, with another plurality of braided components such that the collection of tows at the intersection, 615, may be configured to form a braid unit cell. The intersection, 615, may include at least some tows, of a first collection of tows in a first braided component 601", that may be redirected to form at least some tows of a second collection of tows in a second braided component 605", wherein the first braided component 601" and the second braided component 605" may be connected by continuous tows exchanged between the first collection of tows and the second collection of tows.

In one embodiment, the braided material includes a plurality of braided components, each of the plurality of braided components including a collection of tows configured to form a braid unit cell, and at least one of the plurality of braided components including at least one intersection with another of the plurality of braided components; and, the intersection including at least a first set of tows, of a first collection of tows in a first braided component, that are reoriented to discontinue intertwining with a second set of tows of the first collection of tows, and to intertwine with at least a third set of tows of a second collection of tows in a second braided component. In addition, in a further embodiment, the first braided component and the second braided component intersect based on continuous tows configured to be oriented in each of the first collection of tows to form a first braid unit cell and the second collection of tows to form a second braid unit cell. In additional embodiments, the first braid unit cell includes the first collection of tows intertwined at a first angle relative to the longitudinal axis, and the second braid unit cell includes the second collection of tows intertwined at a second angle relative to the longitudinal axis, wherein the first angle and the second angle may be substantially the same. In an alternative embodiment, the first angle and the second angle may be different.

FIG. 13F illustrates a slit pi shaped braided structure 1300 oriented such that 601' and 601" are oriented along the X axis and 605' and 605" are oriented along the Z axis. FIG. 13G illustrates the slit pi shaped braided structure 1300 oriented such that 601' and 601" are oriented along the X axis and 605' and 605" are oriented along the Y axis. FIG. 13H is an additional view of the slit pi shaped braided structure of FIGS. 13F and 13H such that braided components 601' and 601" are oriented along the Z axis and braided components 605' and 605" are oriented along the Y axis. FIGS. 13G and 13H comprise a series of pairs of lines transverse to the longitudinal axis which may be used to differentiate points within the repeating pattern of the interlocking braided structure illustrated in FIGS. 13G and 13H. This series of pairs of gridlines is not representative of physical aspects of the braided structure illustrated in FIGS. 13G and 13H.

The first braided component 601" may be comprised of a first set of tows, as illustrated in FIG. 13F, comprising a plurality of subsets of tows. The first set of tows 1373 illustrated in FIG. 13F may comprise tow subsets 1351 and 1353, wherein tow subset 1351 may be a first tow subset and tow subset 1353 may be a second tow subset. Additionally, the first braided component 601" may comprise a second set of tows 1375 intertwining with the first set of tows 1373. The second set of tows 1375 may include tow subsets 1355 and 1357, wherein tow subset 1355 may be a third tow subset and tow subset 1357 may be a fourth tow subset. Within the first braided component 601", the second tow subset 1353 may intertwine with the fourth tow subset 1357 at location 1363 and the first tow subset 1351 may intertwine with the third tow subset 1355 at point 1365. Tow subsets comprising a single set may be oriented as substantially parallel to one another.

As the pattern of tow sets may be traced from the first braided component 601" to the second braided component 605", moving from the leftmost edge of the pi shaped braided structure 1300 towards the rightmost edge of the pi shaped braided structure 1300, each tow subset may encounter an intersection 615 at which the first braided component 601", the second braided component 605" and the transition braided component 609 meet. Each subset of tows within the final slit pi shaped braided structure may encounter the intersection 615 and transition in one of two manners; the first manner in which a subset of tows may transition includes the transition of the subset of tows from the first braided component 601" through intersection 615 to the second braided component 605", through the mating half 605' of the second braided component, through the intersection 613 and through the transition braided component 609 and back into intersection 615 and finally back into the first braided component 601"; the second manner in which a subset of tows may transition within the slit pi shaped braided product from first braided component 601", through intersection 615, through the transition braided component 609, through intersection 613 and the mating half 605' of the second braided component 605", through the second braided component 605", through intersection 615 and back into the first braided component 601".

The two manners in which tows may transition in the slit pi shaped braided structure have been discussed in relation to the completed pi shaped structural member. It may be understood that the second manner of transition of a tow as described herein may occur in the same manner in which the braided structure was formed while the first manner of transition as described herein may occur in opposition to the manner in which the braided structure was formed.

Further, the second manner of transition may be compared to the transitions a single tow may make between components of the non-slit braided structure as discussed herein in FIGS. 7A-7D. As the subset of tows may transition from the first braided component 601" through intersection 615 and the transition braided component 609, through intersection 613 and into the mating half 605' of the second braided component 605" the transition may occur in the same manner depicted in FIG. 7C, but in a different angle, in which the tow 701 was described as transitioning from the first braided component 601 to the second braided component 605 by intertwining with tows of the transition braided component 609. Subsequently, as the subset of tows in the second manner of transition may transition from the mating half 605' of the second braided component 605" to the second braided component 605" through intersection 615 and into the first braided component 601", the transition may occur in the same manner as shown in FIG. 7B in which the tow 701 may bend from the second braided component 605 to the first braided component 601 through intersection 615, but may not intertwine with tows of the transition braided component 609.

As illustrated in FIGS. 13F-13H the first tow subset 1351 and second tow subsets 1353, subsequent to intertwining with the third 1355 and fourth 1357 tow subsets, may encounter the intersection 615 and may transition in the second manner as described herein, such that the first subset 1351 and second subset 1353 of tows may encounter the intersection 615 and may transition from the first braided component 601" through the transition braided component 609 and intersection 613 through the mating half 605' of the second braided component 605" through the second braided component 605" through intersection 615 and back into the first braided component 601". In opposition, the third 1355 and fourth 1357 tow subsets, subsequent to intertwining with the first 1351 and second 1353 tow subsets may encounter the intersection 615 and may transition in the first manner as described herein such that the third and fourth tow subsets may transition from the first braided component 601" through intersection 615, into the second braided component 605", through the mating half 605' of the second braided component 605", through the second braided component 605", through intersection 613 and the transition braided component 609 and back into intersection 615 and finally back into the first braided component 601".

As the first subset of tows 1351 transitions through the intersection 615, the first subset of tows 1351, of the first set of tows 1373, may intertwine with tows of other subsets in the second braided component 605" at locations 1387 and 1385 such that the first subset of tows 1351 may intertwine with at least the third subset of tows 1355, of the second set of tows 1375, at location 1387 and may intertwine with at least the fifth subset of tows 1359, of the third subset of tows 1377, at location 1385. As the second subset of tows 1375, of the first set of tows 1373, may transition through the intersection 615 the tows of the second subset 1353 may intertwine with tows of other subsets in the second braided component 605" and the mating half 605' of the second braided component 605' such that the second subset of tows 1353 may intertwine with at least the fourth subset of tows 1357, of the second set of tows 1375, at location 1381 and at least the sixth subset of tows 1361, of the third subset of tows 1377, at location 1383.

As illustrated in FIGS. 13F-13H, while tow subsets may intertwine with tows in the first braided component 601" and the second braided component 605", tows subsets may additionally intertwine with tow subsets within the transition braided component 609. FIG. 13F illustrates the intertwining of tow subsets in the transition braided component 609 such that at least the third subset of tows 1355 may intertwine with the sixth subset of tows 1361 at location 1389, the second subset of tows 1353 may intertwine with the fifth subsets of tows 1359 at location 1391 and the first subset of tows 1351 may intertwine with the fourth subset of tows 1357 at location 1393.

Figure 13I:
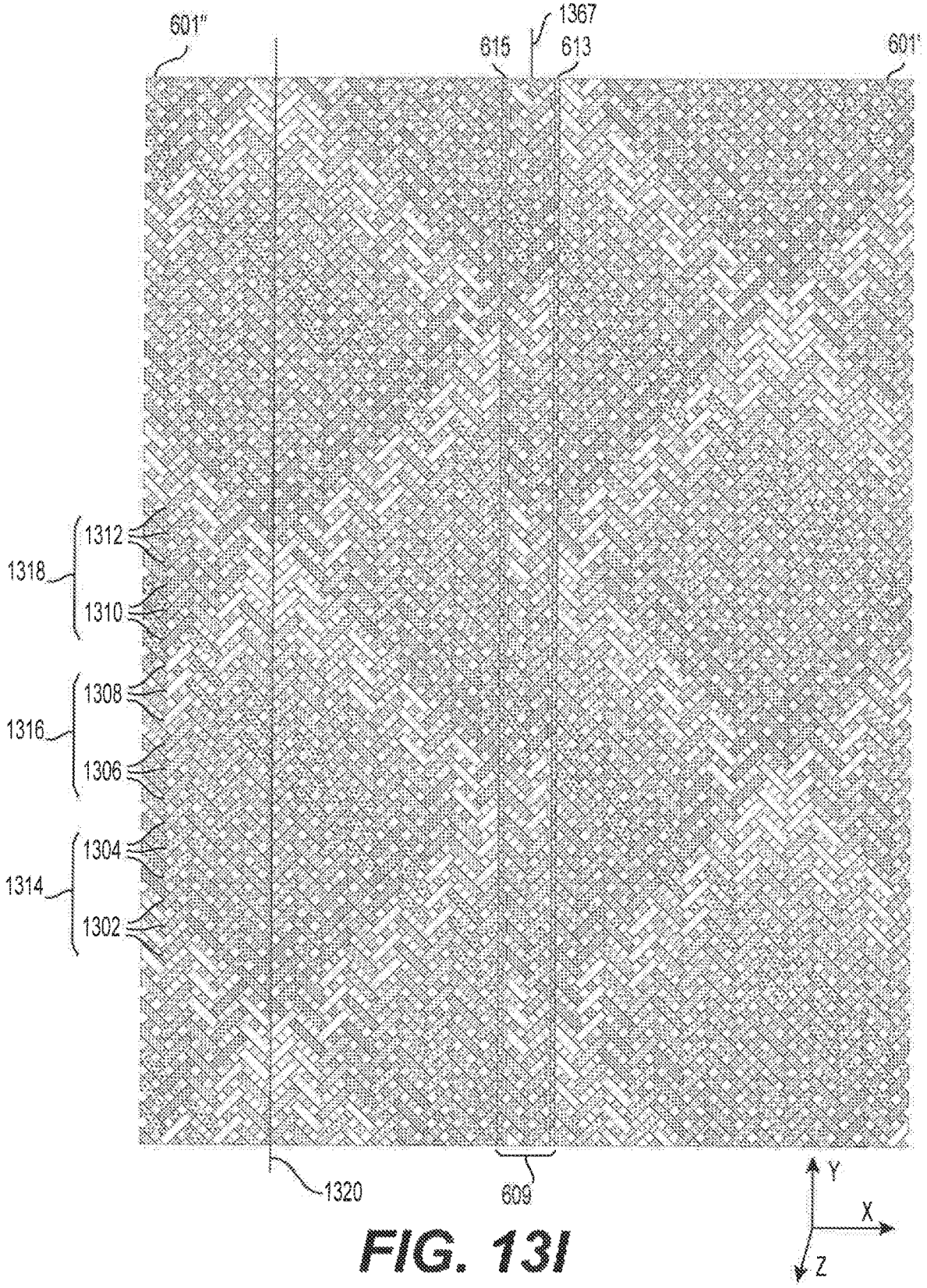
FIG. 13I illustrates the long pi shaped structural member of FIG. 13F in which all sets of tows have been shaded to show the intersection of different sets of tows.

FIG. 13I is illustrative of FIGS. 13F-13H in which the repeating patterns of intertwining of subsets tows in the first braided component 601" and the transitional braided component 609 may be illustrated. The braided structure of FIG. 13I may be comprised of six subsets of tows as with FIGS. 13F-13G, 1302, 1304, 1306, 1308, 1310 and 1312, each comprising a set of tows 1314, 1316 and 1318. Each subset of tows may intertwine with all other subsets of tows within the first braided component 601" such that, in an example, tow subset 1302 may intertwine with tow subsets 1308, 1310, 1312, 1302, 1304 and 1306 in a repeating pattern from left to right along the longitudinal axis 1367 of the braided structure. Additionally, each subset of tows may intertwine with itself in a repeating pattern along the longitudinal axis 1367 such that tow subset 1302 may intertwine with itself along line 1320 followed by tow subsets 1304, 1306, 1308, 1310 and 1312. This same pattern may be observed for the mating half 601' of the first braided component 601" as well as within the second braided component 605" and its mating half 605'.

In a continuing example of FIG. 13I, tow subsets comprising sets 1314, 1316 and 1318 may intertwine in the transitional braided component in a repeating pattern of pairs along the longitudinal axis 1367 such that tow subsets 1306 and 1312 may intertwine followed by tow subsets 1302 and 1308 and tow subsets 1310 and 1304 such that tow subsets pairs may intertwine with other tow subset pairs which precede and follow each tow subset pair along the longitudinal axis 1367 of the braided structure.

Figure 14:
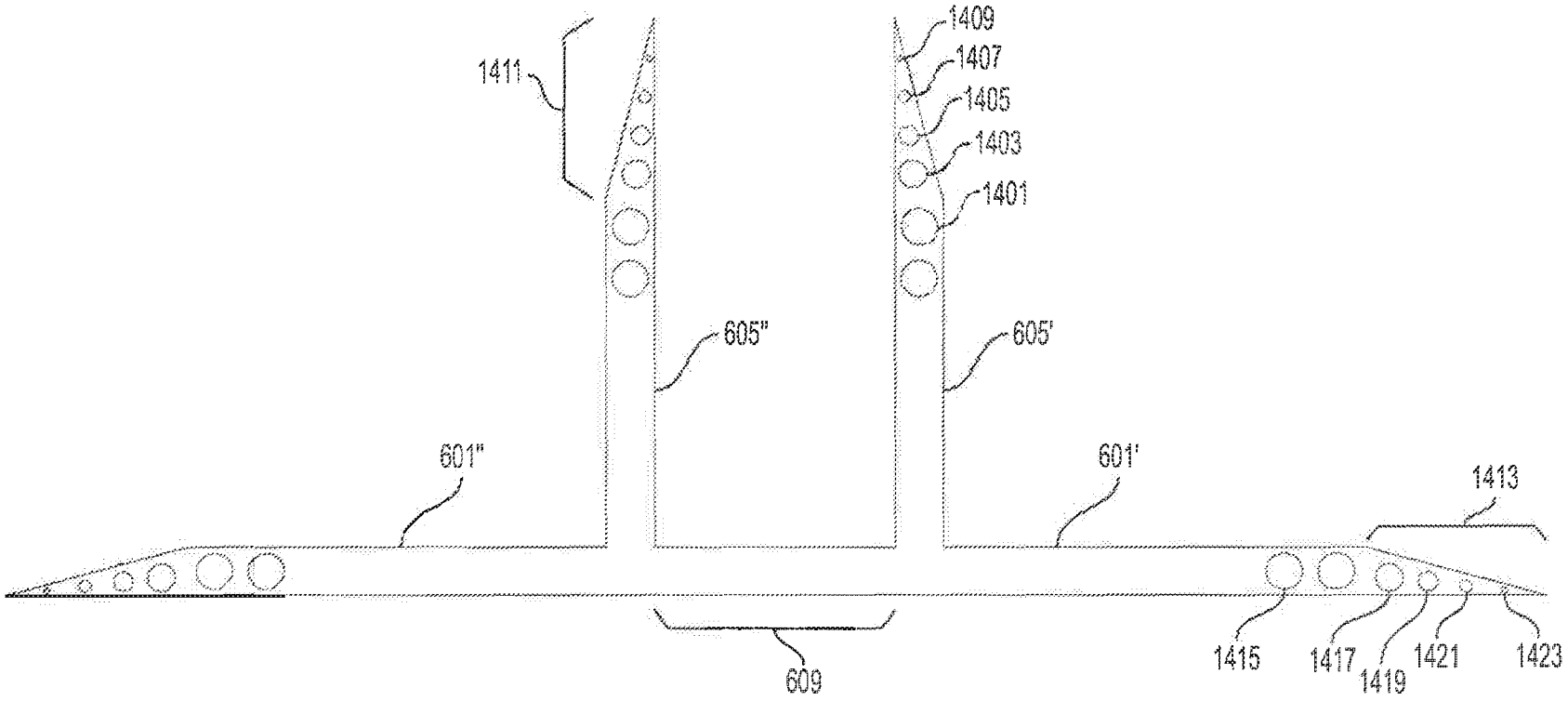
FIG. 14 illustrates a side view of the shaped structural member of embodiment herein in which the ends of a plurality of braided components have been tapered.

As described in an embodiment of the present subject matter in FIG. 10, the width of axial tows may be transitionally decreased around the slitting location 1001 of the braided structure of the present subject matter. FIG. 14 is illustrative of the final slit product of FIG. 10 in which the decrease in the width of tows in the mating half 601' of the first braided component 601" along section 1413 from tow 1415 through 1417, 1419, 1421 and finally 1423 may be observed. Additionally, this same decrease in tow width is illustrated along section 1411 in the mating half 605' of the second braided component 605" as the tow width may decrease from tows 1401 through 1403, 1405; 1407 and finally 1409. As a result of the incorporation of tows with decreasing tow width around the slitting line 1001 of FIG. 10, tapered ends may be achieved for the slit pi shaped braided product of embodiments of the present subject matter. Further, tow width may be varied within other portions of the braided structure to create variations in the width of the braided product at specific locations as desired.

Figure 13J:
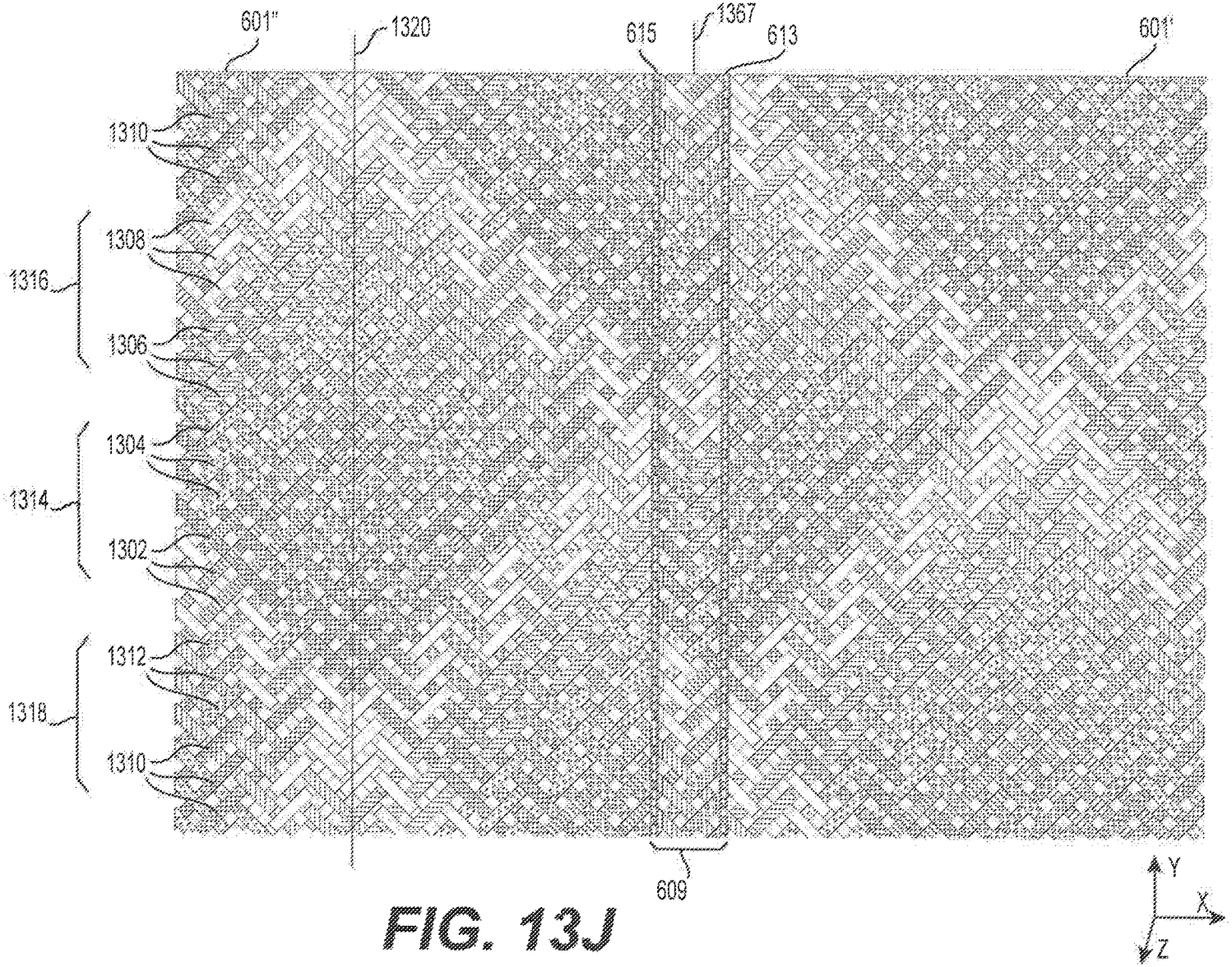
FIG. 13J illustrates a portion of the long pi shaped structural member of FIG. 13I in which all sets of tows have been shaded to show the intersection of different sets of tows.

FIG. 13J illustrates a portion of the interlocking braided structure of FIG. 13I in which the repeating patterns of the intertwining of tow sets and subsets may be observed. As described in the discussion of FIG. 13I each subset of tows 1310, 1312, 1302, 1304, 1306 and 1308 within the first braided component 601" may intertwine with each other subset of tows 1310, 1312, 1302, 1304, 1306 and 1308 comprising the first braided component 601". The intertwining of each subset of tows with each other subsets of tows may also occur in the second braided component 605".

Figure 15:
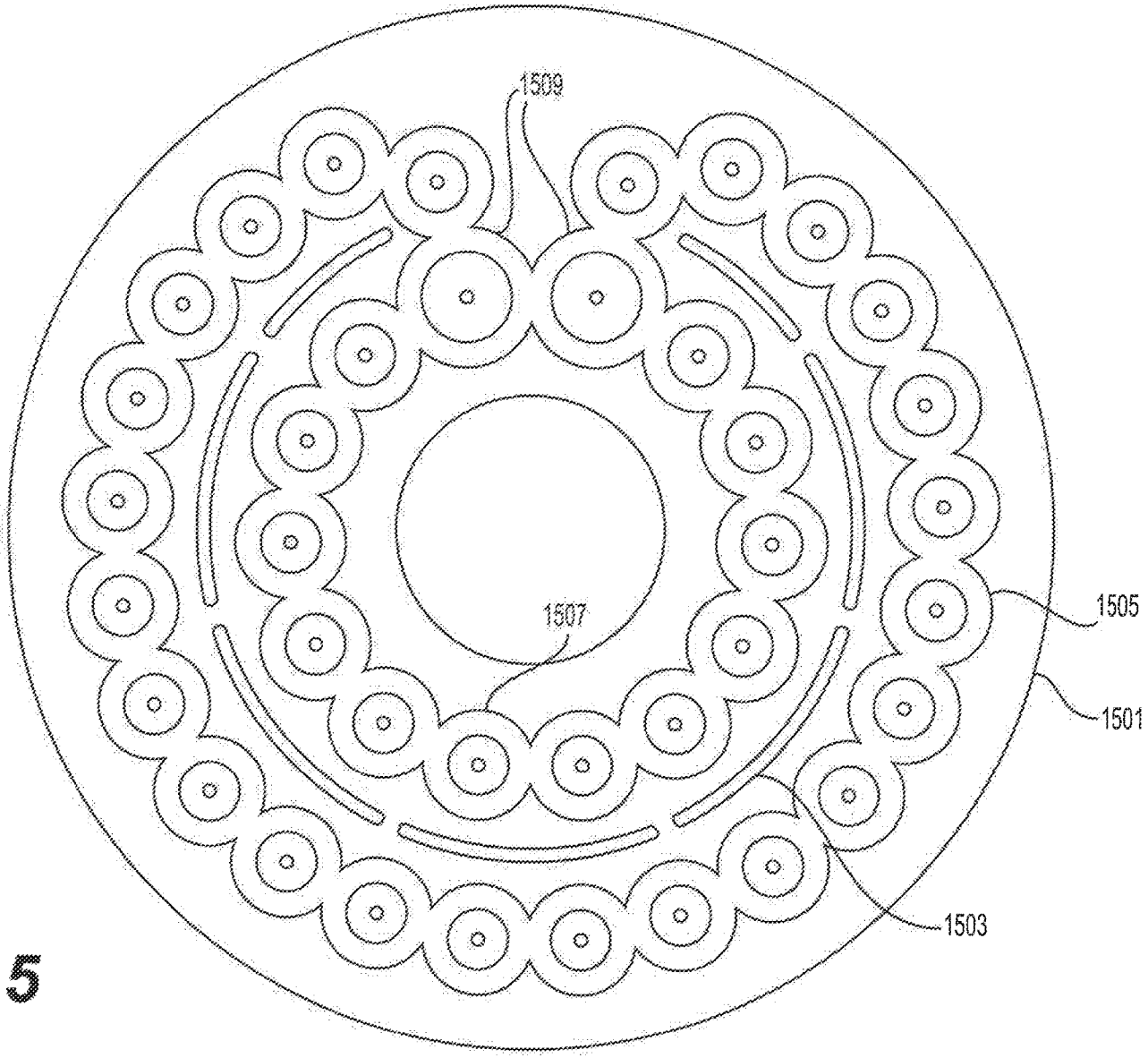
FIG. 15 illustrates a simplification of a top plate and braiding machine tracks of an interlocking braiding machine for the formation of pi shaped structural members of embodiments of the present subject matter.
Figure 16:
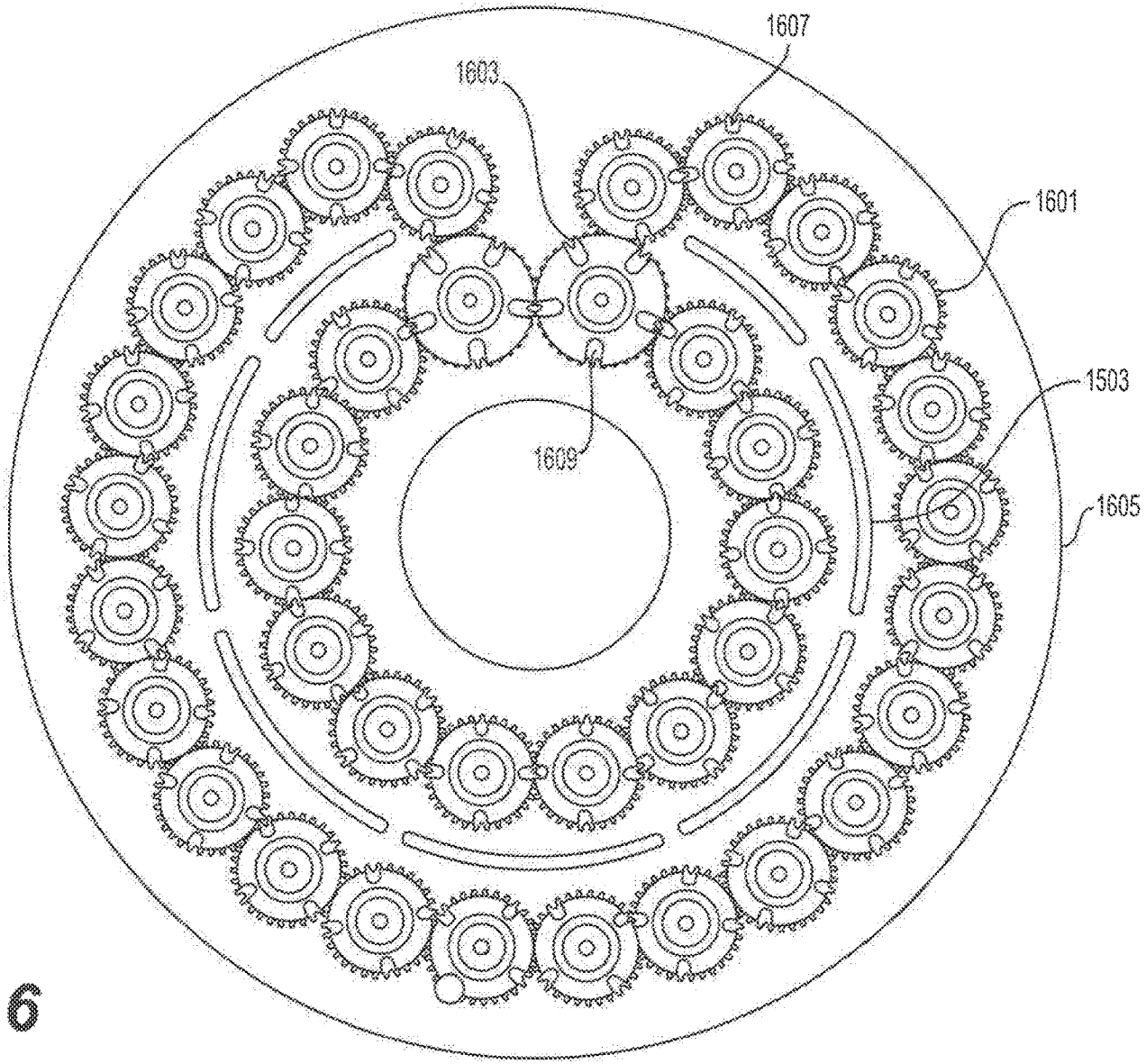
FIG. 16 illustrates horn gears and hub gears which may comprise embodiments of a braiding machine for the formation of pi shaped structural members of embodiments of the present subject matter.
Figure 17:
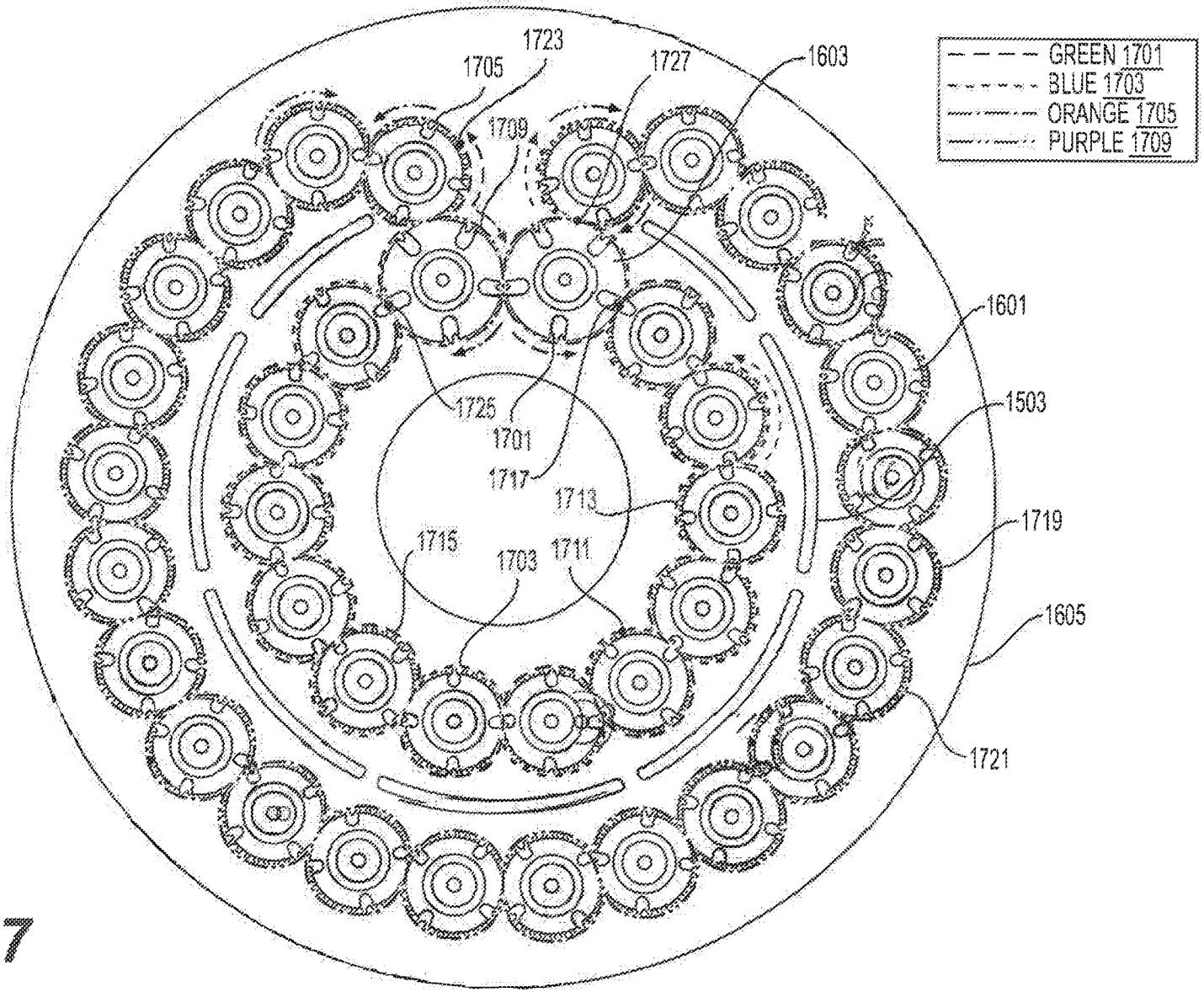
FIG. 17 is illustrative of the path of a single tow carrier device around a braiding machine of embodiments herein for the formation of pi shaped structural members of embodiments of the present subject matter.

The braiding machine of embodiments of the interlocking braiding machine herein for the formation of a pi shaped braided structure is illustrated in FIGS. 15-17, As described herein the braiding machine of the present subject matter may be comprised of two standard braiding machine paths interconnected through portions of shared braiding machine track. The braiding machine of embodiments of the pi shaped braided structure may be comprised of an outer braiding machine track 1505, and an inner braiding machine track 1507 interconnected by a portion of shared braiding machine track 1509. FIG. 15 illustrates the top plate 1501 of the interlocking braiding machine for the formation of pi shaped braided structures which may comprise inner 1507 and outer 1505 braiding machine tracks. Axial tows may be inserted through holes 1503 in the top plate 1501 and bottom plate of the interlocking braiding machine of the present subject matter.

FIG. 16 is illustrative of horn gears 1601 dispersed on a bottom plate 1605 arranged to transfer tow carrier devices between them to form the braided structure of the present subject matter. Horn gears 1601 located beneath the inner 1507 and the outer 1505 braiding machine tracks may transfer tow carrier devices in a similar manner to conventional braiding machines such that each of the inner 1507 and outer 1505 braiding machine tracks may comprise S and Z edges as discussed herein on which S or Z traveling tow carrier devices may travel. The first braided component 601 of FIGS. 6A-10 may be formed through the transfer of tow carrier devices between horn gears 1601 located beneath the outer braiding machine track 1505 while the second braided component 605 may be formed by the transfer of tow carrier devices between horn gears 1601 located beneath the inner braiding machine track 1507. The transfer of tow carrier devices between hub gears 1603 and horn gears 1601 of the outer 1505 and inner 1507 braiding machine tracks may result in the creation of the transitional braided component 609 as described in embodiments of the present subject matter herein.

The horn gears 1601 of the present subject matter may each comprise four slots 1607, as in horn gears of conventional 2×2 braiding machines. Horn gears 1601 comprising four slots 1607 allow for the acceptance and transfer of two tow carrier devices per horn gear on average for the formation of a 2×2 braided structure. Genera the number of slots 1607 required by each horn gear 1601 in a standard braiding machine may be equal to 2N, wherein N is an integer equal or greater to one, such that N represents the number of tow carrier devices passing over and under each other in a braiding machine. In an example, for the formation of a 3×3 braided structure each horn gear 1601 may be able to accept and transfer a total of three tow carrier devices on average for the formation of the 3×3 braided structures and may therefore comprise six slots. However, the hub gears 1603 of the present subject matter may comprise five slots 1609 for the acceptance and transfer of two to three tow carrier devices at any one point in time between the inner 1507 and outer 1505 braiding machine tracks.

The fifth slot 1609 comprising each hub gear 1603 may serve as a timing element to avoid tow carrier device collision as tow carrier deceives may be transferred between the inner 1507 and outer 1505 braiding machine tracks and the portion of shared 1509 braiding machine track. Through the incorporation of a fifth slot 1609 in each hub gear 1603 tow carrier devices transferred between adjacent hub gears 1603, through the portion of shared braiding machine track 1509, as well as the inner 1507 and outer 1505 braiding machine tracks may pass one another without collision. Omission of the incorporation of at least an additional slot 1609 in a hub gear 1603 may result in an event in which a first tow carrier device to be transferred from a first hub gear 1603 to a second hub gear 1603 and a second tow carrier device to be transferred from the second hub gear 1603 to the first hub gear 1603 may occupy the same corresponding slot 1609 in each hub gear 1603, in which one tow carrier device may be accepted in one hub gear and transferred in another, such that tow carrier device collision may occur.

In general, the configuration of a braiding machine for manufacture of the braided structures discussed herein may comprise horn gears to affect transfer of tow carrier devices around the braiding tracks and to maintain timing of tow carrier devices within the tracks and may also comprises hub gears at transition points to redirect tow carrier devices onto other braiding tracks. In general, the configuration of the hub gears may be adapted to transfer and maintain timing between braiding tracks associated with the intersection. In the example of FIG. 15, and as discussed above, the hub gears may be configured with an additional slot to maintain tow carrier transfer timing between the four-slot horn gears in inner 1507 and outer 1505 braiding machine tracks. The configuration of hub gears may also be adapted to affect a desired braid structure at an intersection or in a braided component. For example, additional pairs of slots may affect additional or modified intertwining within the transition component.

The configuration of braiding machines for manufacture of braided structures may be adapted to a range, or family, of related braid structures, or adapted to a single braid structure. The configuration of the hub gears for a particular braiding machine may be determined in at least part by the range of braid structures to be produced, the numbers of braid components, the numbers of intersections, the numbers of transition components and the relative orientations of braiding machine tracks and intersections. During the production of a braided structure at least some hub gears may accept tow carriers devices from a first braiding track and may transfer them to a second braiding track or back into the first braiding track. One hub gear may be perform this operation across multiple sets of braiding tracks and may maintain timing of tow carrier devices across the multiple sets without creating tow carrier device collisions, or as described above, without two carrier devices entering the hub gear at the same location.

Prior to design of a braiding machine, the configurations of the horn and hub gears may be simulated using timing or sequencing diagrams and adapted accordingly to affect the desired timing. Various alternatives may be tested and selected based on the particular production requirements.

As described in the specification herein, a single tow carrier device which may comprise the braiding machine of embodiments of the interlocking braiding machine for the formation of a pi shaped structural member may travel on all S and Z edges which may comprise the outer braiding machine track 1505, the inner braiding machine track 1507 and the portion of shared 1509 braiding machine track. This is illustrated in FIG. 7A-7D in which the path of a single tow is shown as it travels throughout the braided structure of embodiments of the interlocking braided structure of the present subject matter.

FIG. 17 is illustrative of the braiding machine of FIGS. 15 and 16 on which the path of a single tow carrier device as it may travel between the inner 1507, outer 1505 and portions of shared 1509 braiding machine track is depicted. A single tow carrier device along path 1703, may begin the braiding process at a position 1711 on an S edge 1713 of the inner braiding machine track 1505. The tow carrier device may then travel counterclockwise from position 1711 until the tow carrier device may reach position 1717. At position 1717, the tow carrier device may be transferred from a horn gear 1601 to a first hub gear 1603. The tow carrier device may then travel along the hub gear from the inner braiding machine track 1507 to the outer braiding machine track 1505, at which point the tow may bend as illustrated in FIG. 7B. At this point in the braiding process, the tow carrier device may not interact with tow carrier devices within the portion of shared braiding machine track 1509.

As the tow carrier device may travel from the inner braiding machine track 1507 to the outer braiding machine track 1505 the tow carrier device may travel on Z edges 1719 of the outer braiding machine track 1505 along path 1709 and may continue to intertwine with tows comprising the outer braiding machine track 1505 in the clockwise direction. At point 1723 the tow carrier device may be transferred from a horn gear 1601 to a second hub gear 1603 and may then again be transferred from the second hub gear 1603 to the first hub gear 1603 and finally to a horn gear of the inner braiding machine track 1507. This transfer of the tow carrier device from the outer braiding machine track 1505 to the inner braiding machine track 1507 is illustrated in FIG. 7C. At the transition described in this step in the braiding process, the tow carrier device may interact with other tow carrier devices traveling on the portion of shared braiding machine track 1509. At this point the tow carrier device may travel along Z edges 1715 of the inner braiding machine track 1507 along path 1701 in the clockwise direction until point 1725 may be reached.

At point 1725 the tow carrier device may be transferred from a horn gear 1601 to the second hub gear 1603 and may travel along the second hub gear 1603 until the tow carrier device may be passed from the second hub gear 1603 to a horn gear on the outer braiding machine track 1505. The tow carrier device may then travel along S edges 1721 of the outer braiding machine path 1505 along path 1705 in the counterclockwise direction until point 1727 is reached. This transfer of the tow carrier device from the inner braiding machine track 1507 to the outer braiding machine track 1505 may be illustrated in FIG. 7D. At this transition in the braiding process the tow carrier device may not interact with other tow carrier devices traveling in the portion of shared braiding machine track 1509.

At point 1727 the tow carrier device may be transferred from a horn gear 1601 on the outer braiding machine track 1505 to the first hub gear 1603 and may then travel along the first hub gear 1603. The tow carrier device may then be transferred from the first hub gear 1603 to the second hub gear 1603 and to a horn gear 1601 on the inner braiding machine track 1507. The tow carrier device may then travel along S edges of the inner braiding machine track 1507 until point 1717 is reached and the cycle may continue. During this transition in the braiding process the tow carrier device may interact with tow carrier devices on the portion of shared braiding machine track 1509. The transition of the tow carrier device from the outer braiding machine track 1505 to the inner braiding machine track 1507 may be illustrated by tow 707 of FIG. 7C.

Figure 18B:
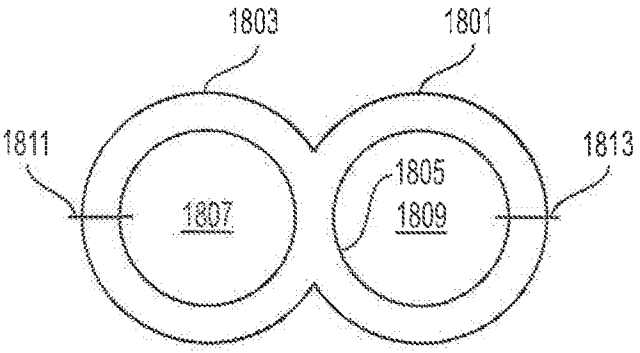
FIG. 18B illustrates the locations at which an interlocking braided structure formed by the interlocking braiding machine of FIG. 18A may be slit.
Figure 18A:
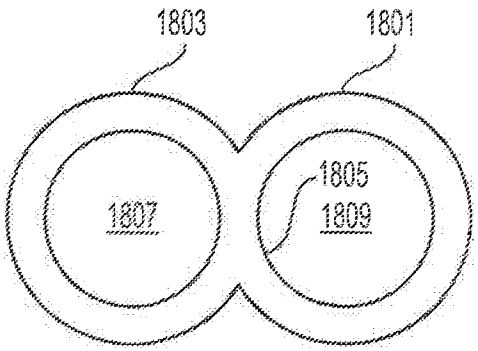
FIG. 18A is illustrative of an additional embodiment of interlocked braiding machine paths.
Figure 19B:
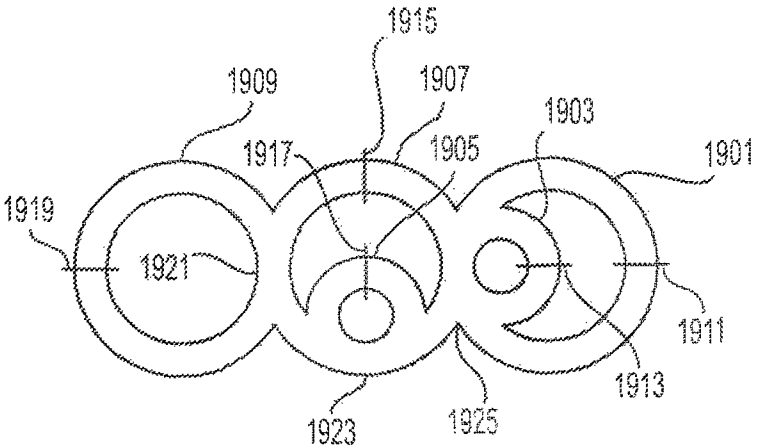
FIG. 19B is illustrative of the locations at which the braided structure formed by the interlocking braided structure of FIG. 19A may be slit.
Figure 19A:
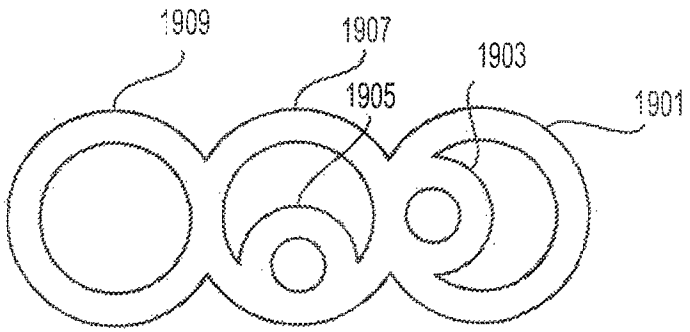
FIG. 19A is illustrative of a complex configuration of interlocking braiding machine paths.
Figure 19C:
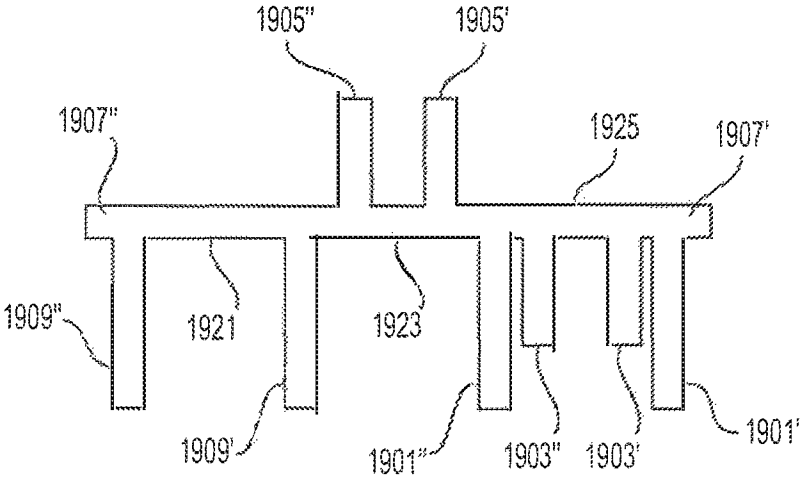
FIG. 19C is illustrative of the structural member which may be obtained by slitting the interlocking braided structure of FIG. 19B.

FIGS. 18A and 19C are illustrative of two additional interlocking braided structures which may be formed through interlocking braiding machines of embodiments of the present subject matter and which may be slit for the creation of structural members like the pi shaped braided structure of embodiments herein.

Figure 18C:
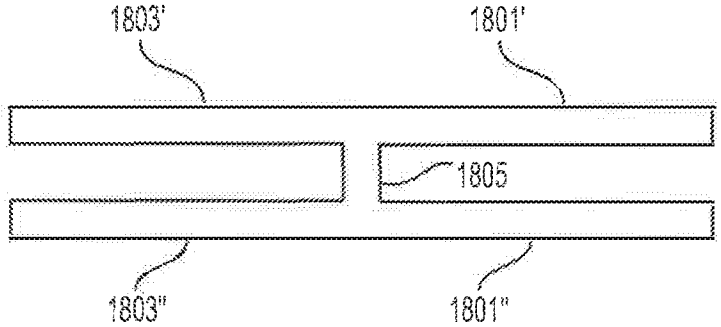
FIG. 18C is illustrative of the I shaped structural member formed by slitting the interlocking braided structure of FIG. 18B.

FIG. 18A is illustrative of two primary interlocking braiding machine paths 1803 and 1801 which may share a portion of common path 1805. Additionally each path 1803 and 1801 may comprise a core 1807 and 1809. The interlocking braiding braided structure formed by the interlocking braiding machine path of FIG. 18A may be slit at the locations 1811 and 1813 of FIG. 18B. Finally, in FIG. 18C the braided structure may be unfolded for the creation of an I shaped structural member which may comprise braided components 1803' and 1803" formed through the slitting of the interlocking braided structure formed by path 1803. Additionally, the I shaped braided structure may be comprised of braided components 1801' and 1801" which were formed through the slitting of the braided structure formed by path 1801 as well as the transitional braided component 1805.

FIG. 19A is illustrative of a complex interlocking braiding machine comprised of primary paths 1909, 1907, 1905, 1903 and 1901. As illustrated in FIG. 19B the interlocking braiding machine paths may share portions of common path 1921, 1923 and 1925. The complex interlocking braided structure formed by the interlocking braiding machine paths of FIG. 19A may be slit in locations 1919, 1917, 1915, 1913 and 1911. Upon the slitting of the braided structure of FIG. 19B, the structural member of FIG. 19C may be created through the unfolding of the slit braided product of FIG. 19B. The final structural member may comprise a plurality of braided components including 1909', 1909", 1901', 1901", 1903', 1903", 1905', 1905", 1907" and 1907'. The interlocking braided components may be joined together through transitional components 1921, 1923 and 1925.

As tows subsets comprising each braided component of embodiments of the interlocking braided structures, wherein the braided components may be configured such that there is an intersection between the two braided components as described herein, may transition from one braided component to each other braided component, each subset of tows may form unit cells with each other subset of tow in each braided component. In an example, tows of a first set of tows intertwining with tows of a second set of tows, forming a first unit cell, within the first braided component may intertwine with tows of a third set of tows in the second braided component, forming a second unit cell. Therefore tows of a first set of tows may participate in unit cells of a first braided component as well as unit cells of each other intersecting braided component.

The interlocking braided structures of the present subject matter may comprise a first braided component interlocked with a second braided component which may include one of a braided tape or a braided structure, wherein the braided structure comprises one of a continuous tow tube or a plurality of pieces of the braided material with continuous tows in each piece of the braided material based on the continuous tow tube including a slit. In addition, the slit may be one of a partial slit or a full slit configured to form a first piece of the braided material and a second piece of the braided material, wherein at least one edge of the first piece of braided material is separated from at least one edge of the second piece of braided material.

The interlocking braided structure of FIGS. 6A-6C of embodiments herein is illustrative of one of two of the basic forms of interlocking braided structures wherein a first interlocking braiding machine path, or braided structure, may be comprised within the core of a second interlocking braiding machine path, or braided structure, in which both interlocking braiding machine paths, or braided structures, share a portion of common path, or structure. While the arrangement of interlocking braiding machine paths for the creation of a pi shaped structural member is one of the basic arrangements of interlocking braided structures, the path of a single tow within the interlocking braided structure for the formation of pi shaped structural members is also representative of a basic, or fundamental, method of the intertwining of tows for the formation of an interlocking braided structure. Generally, for any combination of interlocking braided structures in which one path may be comprised within the core of another path, the method for the formation of the interlocking braided structure may follow that for the formation of the pi shaped braided structure of embodiments herein.

The second basic form an interlocking braided structure may comprise may be a T shaped braided structure, formed through the interlocking of a tape braid within the core of a primary interlocking braiding machine path. The tape braid may be interlocked with the primary interlocking braiding machine path such that a single intersection may interlock the two components to one another. Therefore, unlike the interlocking braiding machine for the formation of pi shaped structural members, the interlocking braiding machine for the formation of a T shaped braided structure may not comprise a transitional braided component and may only comprise a singular intersection between the first braided component comprising the primary interlocking braiding machine path and the second braided component comprising the tape braid.

A T shaped interlocking braided structure comprised of a first and second braided component as described herein may comprise two sets of tows as in a conventional braiding machine. The first set of tows may only travel on S edges of the interlocking braiding machine while the second set of tows may only travel on Z edges of the interlocking braiding machine. The first set of tows and the second set of tows may not exchange directions such that the first set of tows may travel on Z edges of the braiding machine and the second set of tows may not exchange directions to travel on S edges of the braiding machine. Therefore a single tow of the first set may have a unique path compared to a single tow of the second set of tows.

Like the interlocking braided structure for the formation of a pi shaped braided structure, the braided structure for the formation of a T shaped braided structure may comprise a plurality of sets of tows wherein each set of tows may include a plurality of tows being oriented to be substantially adjacent and parallel to each other at an angle relative to a longitudinal axis of the braided structure, wherein each of the plurality of sets of tows may include a plurality of subsets of tows. Further, in at least one repeating braiding pattern along the longitudinal axis, a first braided component may include a first set of tows of the plurality of sets of tows intertwined with a second set of tows of the plurality of sets of tows and a second braided component which may include a first subset of tows of the first set of tows intertwined with a second subset of tows of the first set of tows.

Figure 20A:
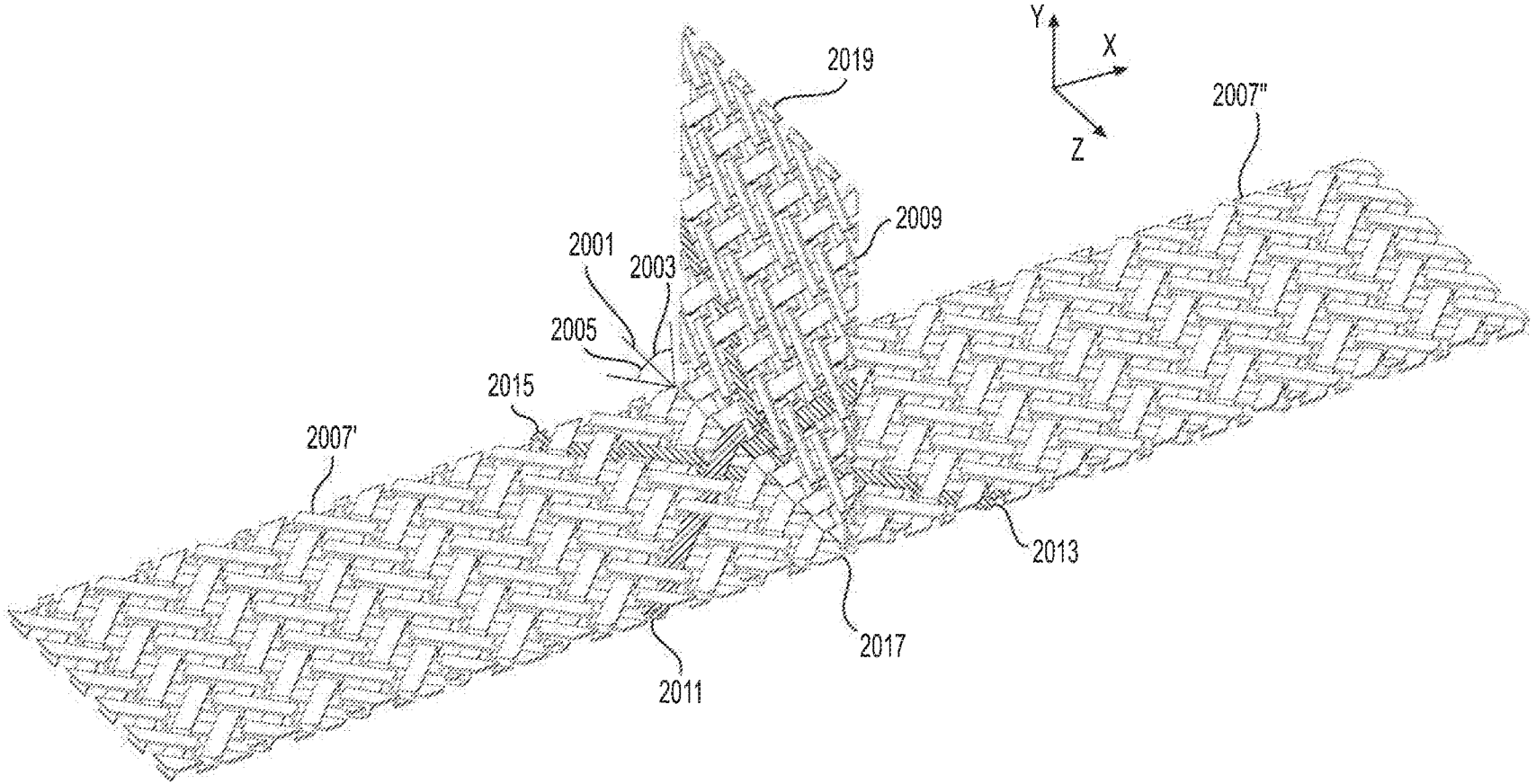
FIG. 20A is illustrative of an angled view of a T shaped structural member of embodiments of the present subject matter.
Figure 20B:
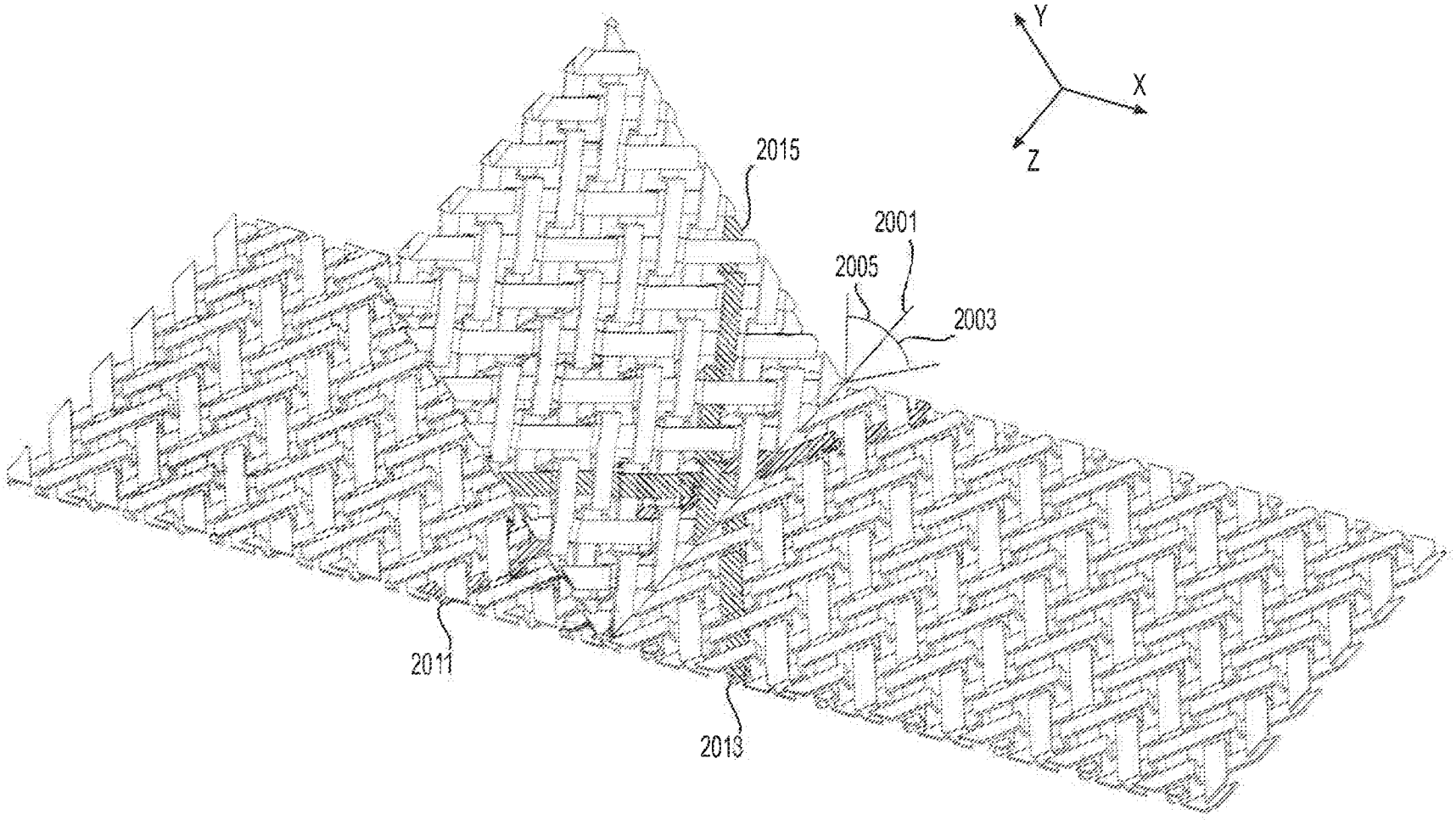
FIG. 20B is illustrative of an additional angled view of the T shaped structural member of FIG. 20A.

FIGS. 20A and 20B illustrate a T shaped structural member wherein braided components 2007' and 2007" may be formed through the slitting of the first braided component, formed by the primary interlocking braiding machine path, wherein the second braided component, the tape braided structure 2009 located within the core of the primary interlocking braided structure may remain unaltered. The slit T shaped braided structure of FIGS. 20A and 20B may comprise two sets of tows, a first set of tows oriented along a positive bias direction 2003 with respect to the longitudinal axis 2001 illustrated by tow 2011, and a second set of tows oriented along a negative bias direction 2005 with respect to the longitudinal axis 2001 illustrated by tows 2013 and 2015. The first set of tows traveling in the positive bias direction 2003 illustrated by tow 2011 may comprise all Z traveling tows, which may never exchange direction.

Within the T shaped braided structure of the present subject matter, the first set of tows may never enter the second braided component 2009 and may only comprise the first braided component. The path of the first set of tows may therefore be identical to that of tows traveling in the Z direction of a conventional braiding machine. However, the second set of tows oriented along the negative bias direction 2005, comprising S traveling tows, illustrated by tows 2013 and 2015 may comprise the first and second 2009 braided components.

The T shaped braided structure of embodiments of the present subject matter may therefore comprise a first braided component, which hereafter will be referred to as 2007' of which the mating half will be defined by 2007", comprising a first set of tows, traveling in the positive bias direction, intertwined with a second set of tows, traveling in the negative bias direction.

While the first set of tows of the braided structure of the present subject matter may only comprise the first braided component 2007', the second set of tows may comprise both the first 2007' and second 2009 braided components. Within the first braided component 2007' the first and second sets of tows may intertwine to form a braided structure. At the intersection 2017 between the first 2007' and second 2009 braided components the first set of tows may continue to travel from the first braided component 2007' though the intersection 2017 and into its mating half 2007", as illustrated by the path of tow 2011 in FIGS. 20A and 20B. As the second set of tows, intertwining with the first set of tows in the first braided component 2007', may encounter the intersection 2017 between the first 2007' and second 2009 braided components, the tows of the second set may bend upwards into the second braided component 2009 and may travel in the same counterclockwise direction until the top 2019 of the second braided component may be reached. At the top 2019 of the second braided component 2009 the tows may bend to continue to travel in the counterclockwise direction downwards towards the intersection 2017 between the first 2007' and second 2009 braided components. Finally, when the second set of tows may again reach the intersection 2017 they may continue through the intersection 2017 and into the mating half 2007" of the first braided component 2007' in the same counterclockwise direction.

The second set of tows, illustrated by tows 2015 and 2013, intertwined with tows of the first set of tows, illustrated by tow 2011, in the first braided component 2007' may comprise a single set of tows comprising two subsets of tows oriented to be substantially adjacent and parallel to each other. As the second set of tows may transition at the intersection 2017 of the first 2007' and second 2009 braided components into the second braided component 2009, a first subset of tows of the second subset of tows may bend upwards into the second braided component 2009. As the first subset, of the second set of tows, may enter into the second braided component 2009 the first set of tows may retain the same orientation along the negative bias direction 2005 of the second braided component 2009 with respect to the longitudinal axis 2001 of the braided structure as shown in FIG. 20B, As the first subset of the second set of tows may reach the top 2019 of the second braided component 2009 the tows may bend, resulting in the formation of a second subset of tows which may intertwine with the first subset of tows of the second set of tows. As tows of the second subset of tows bend to intertwine with the first subset of tows, the tows may be maintained in the negative bias direction 2005 with respect to the longitudinal axis 2001 of the braided structure as illustrated in FIG. 20A. Finally, as the tows may exit the second braided component 2009 and travel through the intersection 2017 both subsets of tows may rejoin in the mating half 2007" of the first braided component 2007'. The intertwining of tows of both subsets of the second set of tows may be illustrated by tows 2015 and 2013 in FIGS. 20A and 20B.

As described in embodiments of the present subject matter, a braided structure for the formation of a T shaped braided structure may comprise the second of two fundamental, or basic interlocking braided structures of embodiments of the present subject matter. Additionally, the paths of the tows within the interlocking braided structure for the formation of a T shaped braided structure may comprise a basic method of the intertwining of tows for the formation of an interlocking braided structure.

An interlocking braiding machine for the formation of a T shaped braided structure may share characteristics of an interlocking braiding machine comprising two interlocking braiding machine paths interlocked in a manner similar to that of FIG. 18A such that two interlocking braiding machine paths may be arranged side by side such that the paths share at least a single intersection between them and each interlocking braiding machine path is arranged within the peripheral of each other interlocking braiding machine path. An intersection as described herein may be equivalent to a single intersection as discussed herein in relation to the pi and T shaped braided structures as described in embodiments herein. Interlocking braiding machine paths oriented in this "figure eight" pattern may each comprise a set of tows which may not shared between each interlocking braiding machine path comprising the interlocking braiding machine. Therefore in an example of the present subject matter, each interlocking braiding machine path may comprise a dedicated set of Z tow carrier devices. However, S tow carrier devices may be shared between the two paths and may result in the formation of an intersection such that the interlocking braided structure formed by a "figure eight" interlocking braiding machine of an embodiment herein may comprise a shared portion of braided structure. Generally, any interlocking braiding machine path which may be interlocked such that each interlocking braiding machine path may be comprised within the peripheral of each other interlocking braiding machine path may be formed in the manner described in embodiments of the interlocking braided structure for the formation of a T shaped structural member as described herein.

Embodiments of the interlocking braided structures of the present subject matter may comprise a plurality of additional braided components, as described in embodiments herein, which may comprise braided tapes or braided tubes, and wherein each of the plurality of braided components includes at least one subset of tows from any of the plurality of sets of tows intertwined with another one of the subsets of tows from any of the other ones of the plurality of sets of tows.

The interlocking braiding machines of embodiments of the present subject matter may comprise a plurality of interlocking braiding machine paths which may comprise portions of shared, or common, braiding machine path of varying circumferential length such that the interlocking braided structures formed may share portions of common braided structure of varying circumferential length.

An additional embodiment of the interlocking braided structures of embodiments of the present subject matter may comprise an interlocking braided structure which may be slit at an angle relative to the longitudinal axis of the braided structure along the full length of the interlocking braided structure or along partial lengths along the longitudinal axis of the braided structure to maintain the contiguity of tows at specific locations along the longitudinal axis of the interlocking braided structure.

Braided structures are deployed into finished products in multiple ways. One common method of deployment is as fiber reinforcement for a rigid composite part where the braid may be embedded in a cured resin matrix. Alternately, the deployment may be into an intermediate form where the braid structure may be pre-impregnated with a resin component and then delivered to a composite manufacturing facility for final deployment into a composite part. As an alternate to a cured resin matrix, braid structures may also be deployed into elastomeric matrices to provide reinforcement for a flexible final structure, such as an air beam.

Further, braid structures may be deployed into a finished product in a "dry" state, i.e. without embedding the braid in a matrix. As an example, braid structures may be deployed in their dry state in jet engine structures to mitigate the damage in blade-out events or as one component of a fabric structure which may be draped over turbines to prevent damage from turbine blade-outs.

CONCLUSION

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A composite structural component including a braided material embedded in a resin matrix, the braided material comprising a plurality of sets of tows formed in a repeating braiding pattern along a longitudinal axis of the braided material, and in at least one pattern of the repeating braiding pattern, the composite structural component comprising:

a first braided component of the braided material, the first braided component including a first set of tows of the plurality of sets of tows intertwined with a second set of tows of the plurality of sets of tows, each of the first and second set of tows including a respective plurality of tows oriented to be substantially adjacent and parallel to each other at an angle relative to the longitudinal axis of the braided material, and each of the first and second set of tows further including a respective plurality of subsets of tows; and a second braided component of the braided material, the second braided component including a first subset of tows of the first set of tows intertwined with a second subset of tows of the first set of tows.

2. The composite structural component of claim 1 further comprising:

at least one surface;

the surface further includes an intersection between the first braided component of the braided material and the second braided component of the braided material; and the intersection includes the at least one pattern of the repeating braiding pattern of the braiding material.

3. The composite structural component of claim 1, wherein the second braided component further includes the first subset of tows of the first set of tows intertwined with at least one of the plurality of subsets of tows of the second set of tows.

4. The composite structural component of claim 1, wherein the second braided component further comprises a third set of tows of the plurality of sets of tows, the third set of tows including a plurality of subsets of tows, wherein the first subset of tows of the first set of tows is intertwined with at least one of the plurality of subsets of tows of the third set of tows.

5. The composite structural component of claim 4, wherein:

the second set of tows includes a third subset of tows and a fourth subset of tows, and the third set of tows includes a fifth subset of tows and a sixth subset of tows; and the second braided component further includes the first subset of tows intertwined with either one of the third subset of tows or the fifth subset of tows, and the second subset of tows intertwined with either one of the fourth subset of tows or the sixth subset of tows.

6. The composite structural component of claim 1, further comprising at least one intersection between the first braided component and the second braided component.

7. The composite structural component of claim 1, wherein:

the first braided component further includes the first set of tows intertwined with the second set of tows at a first angle relative to the longitudinal axis; and the second braided component further includes the first subset of tows intertwined with the second subset of tows at a second angle relative to the longitudinal axis, wherein the first angle and the second angle are substantially the same.

8. The composite structural component of claim 1, wherein the second braided component further includes one of a braided tape or a braided structure, wherein the braided structure comprises one of a continuous tow tube or a plurality of pieces of the braided material with continuous tows in each piece of the braided material based on the continuous tow tube including a slit.

9. The composite structural component of claim 8, wherein the slit is one of a partial slit or a full slit configured to form a first piece of the braided material and a second piece of the braided material, wherein at least one edge of the first piece of braided material is separated from at least one edge of the second piece of braided material.

* * * * *